US005700099A

United States Patent [19]

Kobayashi et al.

[11] Patent Number: 5,700,099

[45] Date of Patent: Dec. 23, 1997

[54] INK JET PRINTER

[75] Inventors: Yoichi Kobayashi; Kiyoto Komuro, both of Nagano, Japan

[73] Assignee: Seiko Epson Corporation, Tokyo, Japan

[21] Appl. No.: 635,317

[22] Filed: Apr. 19, 1996

[30] Foreign Application Priority Data

Apr. 21, 1995 [JP] Japan ..... 7-120762

[51] Int. Cl.[6] ..... B41J 11/58

[52] U.S. Cl. ..... 400/625; 400/642

[58] Field of Search ..... 400/624, 625, 400/642; 347/102, 104

[56] References Cited

U.S. PATENT DOCUMENTS

| | | | |
|---|---|---|---|
| 3,311,371 | 3/1967 | Zeuthen | 271/59 |
| 4,728,963 | 3/1988 | Rasmussen et al. | 346/25 |
| 4,794,859 | 1/1989 | Huseby et al. | 400/625 |
| 4,844,633 | 7/1989 | Greenberg | 400/625 |
| 5,299,875 | 4/1994 | Hock et al. | 400/625 |
| 5,312,196 | 5/1994 | Hock et al. | 400/624 |
| 5,326,090 | 7/1994 | Hock et al. | 271/162 |
| 5,419,644 | 5/1995 | Martin et al. | 347/104 |
| 5,420,621 | 5/1995 | Richtsmeier et al. | 347/104 |
| 5,489,160 | 2/1996 | Patrick et al. | 400/642 |
| 5,523,848 | 6/1996 | Musso et al. | 400/625 |
| 5,536,000 | 7/1996 | Kelly | 347/102 |
| 5,564,847 | 10/1996 | Patrick et al. | 400/642 |

FOREIGN PATENT DOCUMENTS

| | | | |
|---|---|---|---|
| 0 530 821 | 3/1993 | European Pat. Off. | B41J 13/10 |
| 3941315 | 12/1989 | Germany | B41J 13/30 |
| 4330798 | 9/1993 | Germany | B41J 13/00 |
| 62-83977 | 10/1985 | Japan | B65H 31/20 |
| 63-222875 | 3/1987 | Japan | B41J 13/40 |
| 4-341848 | 11/1992 | Japan . | |
| 6-918611 | 4/1994 | Japan . | |

*Primary Examiner*—David A. Wiecking

*Attorney, Agent, or Firm*—Stroock Stroock & Lavan LLP

[57] ABSTRACT

A paper discharge section for a printer having a printer body includes first and second support portions mounted on the printer body. At least one of the support portions is slidable towards and away from the other support portion. The first support portion can rotate between at least a first position at which the first support portion supports a first bottom side portion of the sheet of paper and at least a second position in which the first support portion does not support the first bottom side portion of a sheet of paper. A slidable edge guide for guiding a first side edge of a sheet of paper is provided and slidable towards the other edge guide. A linkage mechanism links the slidable edge guide to the first support portion to cause the edge guide and first support portion to slide together. A switch for reversibly moving the first support portion from a first position at which the first portion supports a first bottom side portion of a sheet of paper when the edge guide is positioned to accept paper that requires support to a second position at which the first support portion does not support the first bottom side portion of a sheet of paper when the edge guide is positioned to accept paper that does not require support upon discharge, and for moving the first support portion from a second position at which the first support portion does not support the first bottom side portion of a sheet of paper when the edge guide is positioned to accept paper that does not require support upon discharge.

38 Claims, 30 Drawing Sheets

INK JET PRINTER

BACKGROUND OF THE INVENTION

1. Field of the invention

This invention relates generally to ink jet printer, and, in particular, to an improved ink jet printer constructed to more accurately and reliably discharge paper, including discharging the paper without causing ink to smear on the discharged sheets of paper.

2. Related Art

Reference is first made to FIGS. 33–35, which depict a conventional printer described in U.S. Pat. No. 5,299,875. This printer includes a printer body, generally indicated at 401 and a paper feed tray 402 positioned at a rear portion of body 401 for receiving and setting paper P in position for delivery for printing. A pair of support portions 403 and 404 and an edge separator 405 are positioned at a front portion of body 401. A pair of recesses 406 and 407 are provided in body 401 to receive support portion 403 and 404, respectively, during non-use and storage of the printer. An ink jet head (not shown) is positioned within body 401. Paper P is supplied to body 401 from paper feed tray 402.

As shown in FIG. 35, after paper P is printed upon by the ink jet head, the paper is discharged while the side edges of paper P are guided and supported by support portions 403 and 404 and the central portion of paper P is guided and supported by edge separator 405. Supporting portion 404 is constructed to be slideable in the paperwidth direction (arrow b, FIG. 34) so as to allow its adjustment to correspond to the width of the paper P being printed upon. Furthermore, when the printer is not in use, supporting portions 403 and 404 are capable of being stored. Supporting portion 404 is constructed to face recess 406 and is capable of rotation in the direction of arrow a of FIG. 34 (to the right of the paperwidth direction). Likewise, supporting portion 403 is constructed to face recess 407 and is capable of rotation.

In another type of conventional printer (not shown), an edge guide assembly may be provided to guide the edges of paper set in a paper feed apparatus. The edge guides, which must be manually positioned, may be permitted to slide in the paper widthwise direction upon a shaft, for example, in order to be set to correspond to the width of a paper being fed into the printer.

Reference is now made to FIG. 36 which depicts a conventional ink jet printer, generally indicated as 500, described in Japanese Unexamined Patent Publication 341848/1992. Printer 500 includes a printing section, generally indicated at 501, which includes an ink jet head 502, and a paper guide member 506 spaced apart from ink jet head 502. Paper guide member 506 has a guide surface **506*a* that contacts the bottom surface of paper P and guides paper P through printing section 501. Printer 500 also includes paper feed rollers 504*a* and 504*b* that rotate as indicated by arrows z1 and z2, respectively, thereby feeding a sheet of paper P therebetween to printing section 501. Ink jet head 502 discharges ink while moving reciprocally in a direction perpendicular to the paper surface and prints on the surface of paper P as it is fed to printing section 501 by paper feed rollers 504*a*, 504*b*. The width A represents the printing region within which ink jet head 502 prints on printer P. A pair of paper discharge rollers 505*a* and 505*b* are rotatably mounted in printer 500 and guide paper P out of printing section 501** so as to be discharged.

One common problem with the above-described conventional ink jet printers, which generally print by discharging ink on a paper and which further require sheets to be continuously printed upon and discharged through the printing section, is that there is insufficient time to permit the ink to dry on a sheet of paper before the next sheet of paper is discharged thereupon. Without any means to sufficiently separate each successive sheet of paper before the previous page dries, the next paper is discharged and slidably contacts the printed surface of the previous printed paper. Therefore, there is a high likelihood that the ink on the printed surface of the previous printed paper will smear.

One ink jet printer construction that has attempted to solve this problem is described in Japanese Unexamined Patent Publication 91861/1994. A perspective view of the paper discharge portion 601 of this ink jet printer is depicted in FIGS. 25–28. Discharge portion 601 includes an ink jet head 660', and a frame 614, which includes thereon a pair of integrally formed supporting portions **612*a* and 612*b*. Supporting portions 612*a*, 612*b* respectively guide and support from below each side portion of paper P, which has been previously printed upon on an upper surface thereof by means of a printing head (not shown) and is being discharged therefrom. Supporting portions 612*a* and 612*b* may be thin, integrally formed, immovable rib-like members, having their respective upper surfaces 612*a*', 612*b*' inclined upwards in the paper discharging direction. A transport section generally indicated as 606 includes a plurality of discharging rollers 682 for discharging paper P, which is eventually discharged onto discharge plate 605, which may be rotatably mounted with respect to discharge frame 614**.

An arm, generally indicated at **613*a*, is rotatably mounted on a frame (not shown). Arm 613*a* includes a pushing-down portion 613, rotatably supported thereon, which may be in the form of a thin, plate-shaped, star wheel. Pushing-down portion 613 exerts a downward force on the central portion of the paper P being discharged from discharge portion 601**.

The paper discharge operation of this conventional type of printer will now be described. Paper P is printed upon in the print section (not shown) and passes into discharge portion 601. At this time, each side of paper P is guided upwardly by upper surfaces **612*a*' and 612*b*' of respective supporting portions 612*a* and 612*b*. At the same time, although the central portion of paper P exerts an upward force on pushing-down portion 613 and rotating arm 613*a*, the central portion of the paper gradually falls below pushing-down portion 613 and is urged downwardly due to the weight of pushing-down portion 613 and arm 613*a* against the central portion of paper P. Thus, as paper P is discharged, it is forcibly urged into a concave shape as viewed in the discharging direction. This type of concave shape may also be achieved without a pushing down portion since the weight of the paper itself may cause the concavity thereof. Nonetheless, as paper P is forcibly urged into this concave shape, the paper will stiffen and will move along in the discharging direction as if it were floating. Because of this, as is more particularly depicted in FIG. 26, the time until discharged paper P slidably contacts a printed surface P1*f* of paper P1 (paper that was previously printed, discharged, and stacked on a paper discharge tray 605) will be delayed. This method of delaying the subsequent sheet of paper from contacting the previously discharged sheet allows sufficient time for the ink to dry on printed paper P1** before contact with paper P takes place.

FIG. 27 illustrates paper P after it has been further discharged from discharge portion 601, and its trailing edge Pb has passed transport section 666. At this time, paper P loses its transporting force in the discharge direction because discharge rollers 606' cease acting on paper P. The rear portion Pc of paper P is maintained in its concave state, however, by the downward force of pushing-down portion 613 upon the central portion of rear portion Pc of paper P and the upward force of support portions 612*a*, 612*b* upon the sides of paper P.

As shown in FIG. 28, as a subsequent sheet of paper P2 enters transport portion 601, it is urged forward by discharge rollers 606' and, as a result, its leading edge P2*a* passes transport section 601. When leading edge P2*a* contacts trailing edge Pb of the preceding paper P, preceding paper P is stacked on the earlier printed paper P1 (FIG. 26). The time until paper P2 contacts printed paper P1 is delayed in the same manner paper P was delayed, described above.

Referring once again to the ink jet printer depicted in FIGS. 33–35, when setting paper of different sizes in paper feed tray 402, it is necessary for the user to slide supporting portion 404 in the direction of arrow b (FIG. 34) to match the width of the paper set therein. However, supporting portion 404 is constructed to rotate only in the paperwidth direction (the sliding direction). Therefore, in the case of carelessness by the user, for example, support portion 404 may be slid by the user without first observing for the presence of obstructions in the sliding direction. In this way, force applied to support portion 404 in a direction in which there is no rotatability, because of an obstruction, for example, will cause damage to the printer and/or supporting portion. For example, if the previously described edge separator 405 is replaced with the aforementioned pushing-down portion, this pushing-down portion may obstruct movement of support portion 404. Thus, where the construction of a printer utilizes both the support portions 403, 404 and attempts to reduce ink smearing by incorporating a pushing-down portion 613*a*, there is an increased possibility that damage will result to the support portion 404 by the carelessness of the user when rotating support portions 403, 404.

Moreover, in printers having an edge guide, it is necessary for the user to slide the edge guide to match the width of the paper when setting paper of a different size in the paper feeder. Accordingly, if it was desired to use both an edge guide and support portions, when setting paper of a different size in a paper feeder apparatus, the user must not only separately slide the edge guide, but also must slide a support portion to match the width of the paper. This multi-setting requirement is complicated and undesirable.

In particular, in the case where a paper feeder apparatus in which paper is set and a discharge portion in which paper is discharged are spaced apart and provided in different planes with respect to each other, a guide which may be set to guide the paper in the paper tray and a discharge portion are positioned far apart from each other. As a result, when setting paper of different sizes in the paper feeder apparatus, even if the user does not forget to slide the edge guide to match the width of the paper, the user may carelessly forget to slide the support portion in the discharge section. If the support portion is not slid to the proper position, a correct discharge operation will not be achieved, and ink will smear on the previously discharged paper.

Still further, in an ink jet printer of the type depicted in FIG. 36, if paper P is warped into a concave shape, the leading edge of paper P might enter the space S between head 502 and discharge rollers 505*a* and 505*b*. If the leading edge of the warped sheet of paper enters space S, the section of the paper having already been printed upon may contact head 502, thereby smudging the not-yet dried ink. Moreover, if the leading edge of the warped paper cannot be properly guided towards discharge rollers 505*a* and 505*b*, the leading edge of paper P will become jammed in space S thereby causing a paper jam condition.

Still further, in an ink jet printer having a paper discharge configuration of the type depicted in FIGS. 25–28, which is capable of printing on paper of different sizes and where paper of different sizes can be discharged, it is desirable that at least one supporting portion, 612*a* or 612*b* be capable of sliding so as to be adjustable to match the width of paper P delivered for printing. However, the sliding of the supporting portion requires a complicated and undesirable printer construction and operation.

On the other hand, as previously described, a type of printer is known where an edge guide for guiding the side of a paper is provided in the paper supply portion. As this edge guide is slid by the user to match the width of a paper when paper of a different size is set in the paper supply portion, if the sliding of this edge guide is linked to the sliding operation of the supporting portion in the discharge portion, there is the benefit of reducing the inconvenience of having to slide the supporting portion each time. However, the conventional linking assemblies that attempt to link the sliding of the edge guide to the sliding operation of the supporting portion do not support all types of paper properly. That is, different types of paper require different support. For example, normal types of paper such as A4 and B5 require the support on both sides of the sheet by a pair of supporting portions. By supporting both sides of the sheet, a fairly reliable discharge operation is obtained. There are also types of paper, such as thick paper, postcards and envelopes, which do not require support on each side thereof. When using paper with comparatively narrow widths, such as postcards or small envelopes, as shown in FIG. 32, both sides of the sheet are supported by supporting portions 612*a* and 612*b* in a known printer. Since the paper is stiff and will not necessarily bend into a concave shape, a stable abutting operation (pushing-out operation), where the trailing edge Pb' of a previous printed paper P' is urged by the leading edge P2'*a* of a following paper P2' is not obtained. The result is that the stacking position of discharged paper P1' is disordered and the order in which the papers lie when discharged is upset as depicted in FIG. 32.

Accordingly, a printer that overcomes the aforementioned disadvantages and limitations, readily discharges, supports and guides paper of different sizes and kinds is desired.

SUMMARY OF THE INVENTION

A printer includes a pair of supporting portions supporting from below both side portions of discharging paper, which has been printed on a top surface by means of a printing section having an ink jet head: A pushing-down portion pushes the middle of the paper in a downward direction; and at least one of the supporting portions is slidable along the paper width and rotatable in either of a first and second direction along the width of the paper.

In a preferred embodiment, the printer has a paper feeder apparatus that includes an edge guide for guiding the edges of a paper. The edge guide is slidable to match the width of a paper delivered for printing. A linking mechanism links the slidable edge guide and a slidable supporting portion so that they slide in unison. The slidable supporting portion is rotatably mounted to be rotated between the supporting position for supporting the paper and at least one non-supporting position in which the supporting portion does not support the paper. That is, when the slidable supporting portion is slid toward the second supporting portion from a range in which the slidable support means is required to support the paper into a range in which the slidable support means is not required to support the discharged paper, the slidable supporting portion is moved into a non-supporting position by a switch. A spring biases the supporting portion towards the Supporting position, and a retaining portion retains the supporting portion in a non-supporting position against the biasing force from the spring.

More specifically, when the edge guide is slid to a position that requires a support member to support discharging paper, the support member automatically assumes a support position, whereas the support member automatically assumes a non-support position when the edge guide is slid to a position in which the paper fed into the printer is not required to be supported by the support member. Therefore, when the type of paper fed into the printer body requires support by the support members, it is printed in the printing area, and, during discharge, both side portions of the paper are supported from below by the slidable support member and the other support member.

When the paper fed into the printer body does not require support by the support members, the paper is printed in the printing area and is not supported by the slidable support member during discharge. Even in this case, however, the paper may be supported by one support member so as to stack discharged paper properly.

In another preferred embodiment, a printer allows relatively firm paper, such as post cards, to be supported by one support member during discharge. In this case, the preceding paper is contacted and pushed at by the following paper by making the leading edge of the following paper contact rear edge of the preceding paper and discharges the paper in tilted condition so that it stacks properly, i.e., a supporting member with a downward-tilted face prevents the paper from being discharged at an angle caused by the contact of the preceding paper, instead discharging the paper in the forward direction in a straight position to achieve a neatly stacked paper pile.

More specifically, the slidable support portion includes a second support member for supporting the side of paper in addition to the slidable support member. When the copying paper fed into the body does not require support by the support member, it is fed into the body, subjected to printing, and discharged so that it is supported by the second support member and the other support portion support member. The second support member has a support face that slopes downward in the direction of discharged paper. The other support portion support member's face slopes upward in the direction of discharged paper, whereby the rear edge of the discharged paper is tilted upward with respect to the other support member. In this manner, the rear edge of the discharged paper contacts the leading edge of the following paper in the vicinity of the upwardly sloped support face of the second support member and is discharged from the discharge portion of the printer. At this time, although contact from the following paper has the effect of turning the discharging paper around the down-sloped support face of the second support member, the discharging paper is discharged in such a manner that it slides down the down-sloped support face of the support member, so that it is discharged without turning in a relatively straight manner.

Accordingly, it is an object of the present invention to provide an improved printer that can more reliably discharge paper.

Another object of the present invention is to provide an improved printer which can discharge paper without the ink on previous sheets of paper being smeared.

Still another object of the present invention is to provide an ink jet printer which can include slidable support portions for accommodating and supporting the bottom surface of varying paper sizes.

Yet another object of the present invention is to provide an ink jet printer which will properly and reliably discharge paper even in cases where the paper is warped.

Still another object of the present invention is to provide an ink jet printer that includes an easy and reliable paper setting operation.

Yet another object of the present invention is to provide an ink jet printer that includes at least one supporting portion and an edge guide in which the sliding operation to properly guide and support the paper is simple.

Yet another object of the present invention is to provide an ink jet printer which can reliably discharge paper of different types and sizes.

Still other objects and advantages of the invention will in part be obvious and will in part be apparent from the specification.

The invention accordingly comprises the features of construction, combination of elements and arrangement of parts which will be exemplified in the construction hereinafter set forth, and the scope of the invention will be indicated by the claims.

BRIEF DESCRIPTION OF THE DRAWINGS

For a fuller understanding of the invention, reference is made to the following description taken in connection with the accompanying drawings in which.

DESCRIPTION OF THE PREFERRED EMBODIMENTS

Figure 1:
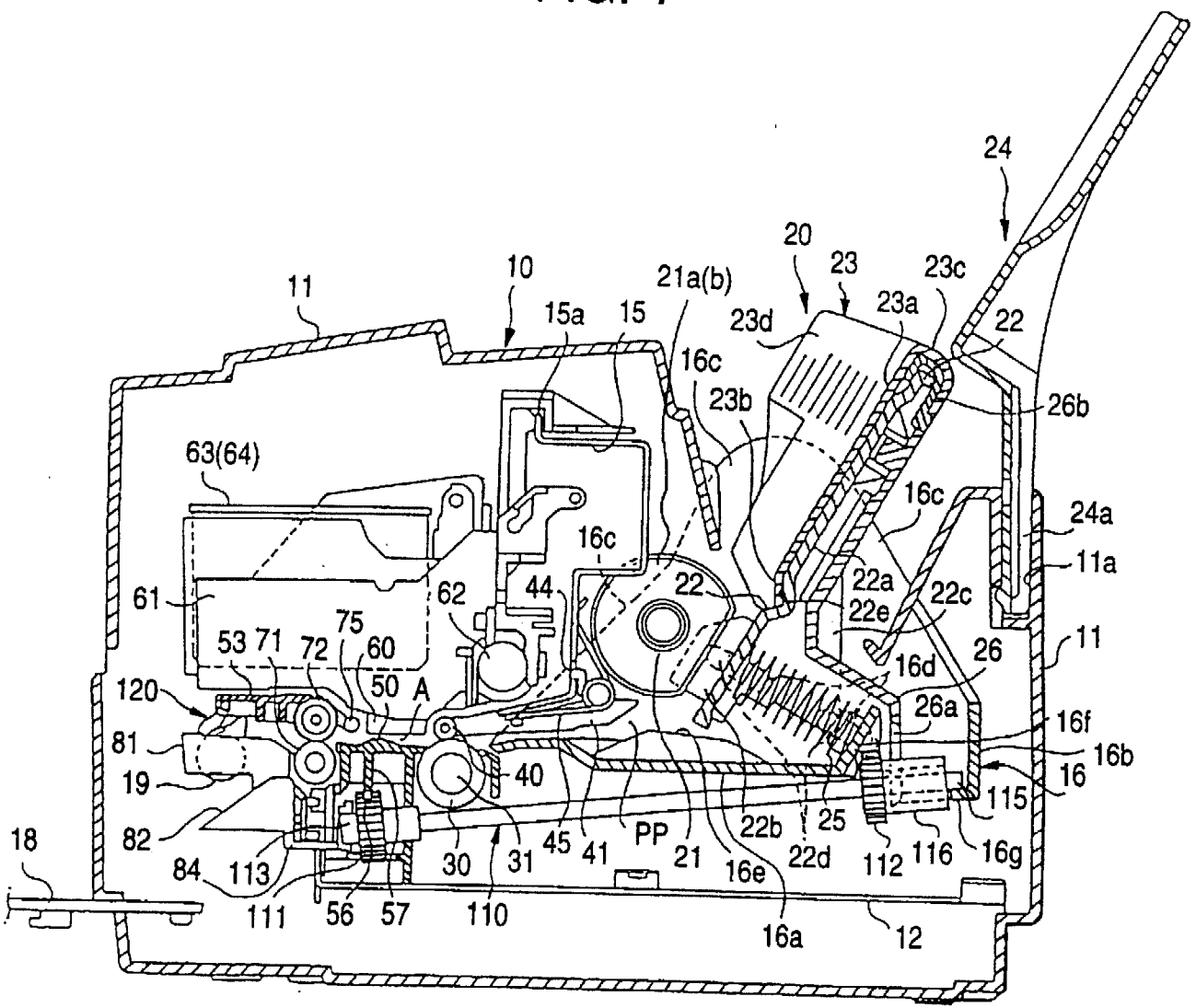
FIG. 1 is a sectional view of an ink jet printer constructed in accordance with a first embodiment of the present invention.
Figure 2:
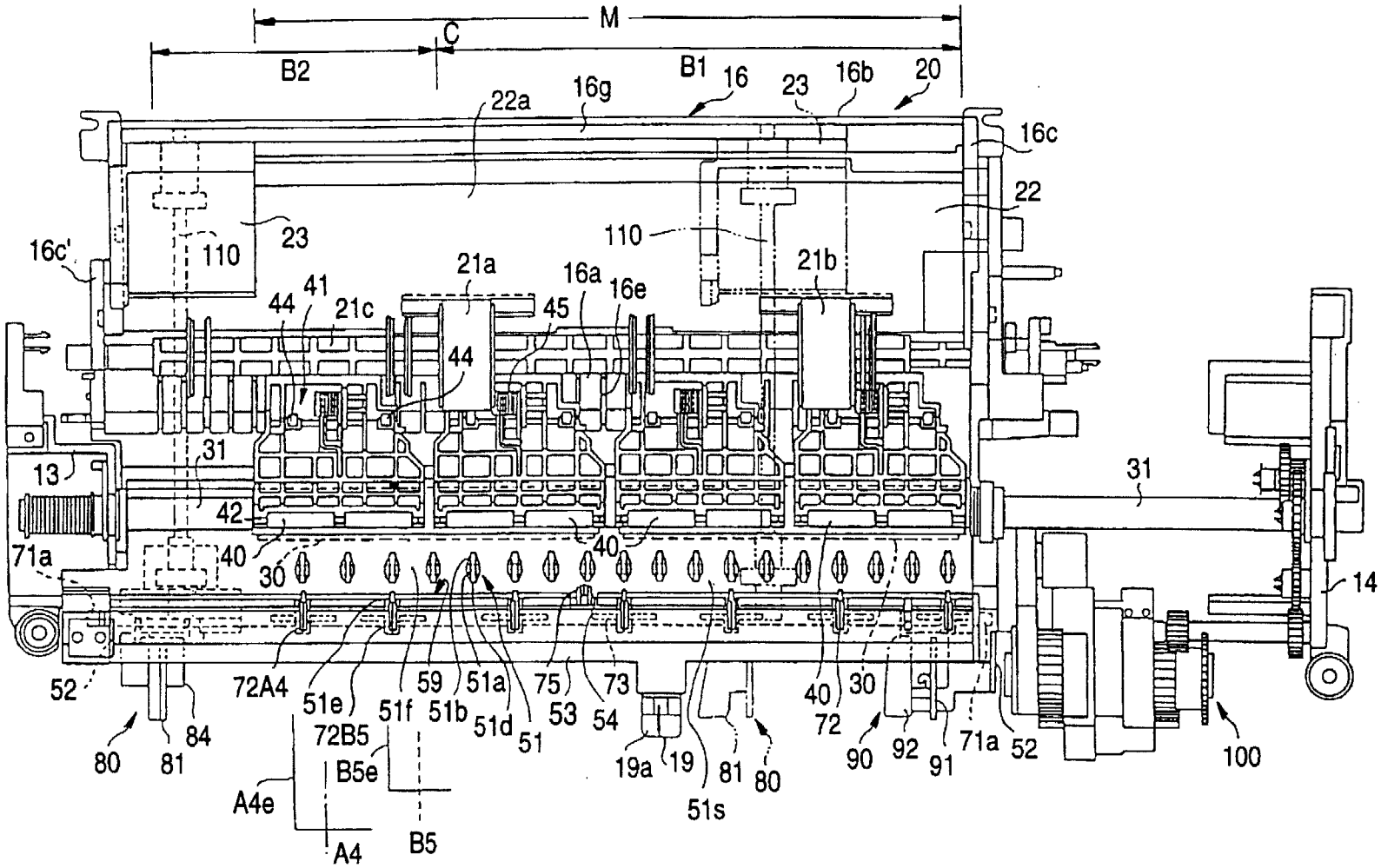
FIG. 2 is a partial top plan view of the ink jet printer constructed in accordance with the invention.

Reference is first made to FIGS. 1 and 2, which depict a printer body, generally indicated at 10, of a printer that, by way of example, may be an ink jet printer, constructed in accordance with a first embodiment of the present invention. Printer body 10 includes a printer case 11 within which an automatic paper feeder apparatus 20 is positioned. More particularly, automatic paper feeder apparatus 20 is positioned in the upper rear portion of printer body 10.

Generally speaking, printer body 10 is supplied with paper P from automatic paper feeder apparatus 20. Printer body 10 includes two paper feed rollers 30, rotatably mounted in body 10, driven pinch rollers 10 rotatably mounted in printer body 10 and in pressing contact with paper feed rollers 30. A regulating member 50 for guiding the bottom surface of a sheet of paper is mounted in printer body 10. An ink jet head 60 for discharging ink onto a sheet of paper is mounted on a reciprocating carriage 61 in facing relationship across a gap with regulating member 50. A guide roller 75 for urging the paper through the discharge section is rotatably mounted in printer body 10. At least one pair of discharge rollers 71 and 72 is rotatably mounted in printer body 10. A discharge portion, generally indicated at 120, is mounted in printer body 10 along the paper feed path PP for paper P (see FIG. 3). Discharge portion 120 is positioned in the front lower portion of printer body 10. A discharge tray 18 for stacking paper discharged from discharge portion 120 is positioned apart from and below discharge portion 120.

Printer body 10 also includes a lower portion frame 12 within printer case 11 preferably made of a metal plate and serving as a shield plate, a left side frame 13 and a right side frame 14 preferably made of plastic and positioned in lower frame 12. An intermediate frame 15, made of a metal plate, is positioned within side frames 13 and 14. A sub frame, generally indicated at 16, is mounted within printer case 11 and is preferably made of plastic. Sub frame 16 fixes each of the above-mentioned frames in their, proper position.

Still further, sub frame 16 includes a lower plate **16*a* forming a lower portion of paper feed path PP (FIG. 3), a back plate 16*b*, integrally formed with lower plate 16*a*, and side plates 16*c* and 16*c*', integrally formed with lower plate 16*a* and back plate 16*b*, located on opposed sides of printer body 10 as shown in FIG. 2. A plurality of rib-shaped paper guides 16*e* extend from the top surface of lower plate 16*a***.

Automatic paper feeder apparatus 20 includes a grooved paper feed roller shaft 21 which is rotatably supported in side plates **16*c* and 16*c*' of sub frame 16, and at the time of paper feeding, is rotatably driven by a transmission mechanism (not shown) connected to a drive mechanism 100. Two paper feed rollers 21*a* and 21*b* are rotatably mounted on paper feed roller shaft 21. Paper feed rollers 21*a* and 21*b* are each preferably constructed as D-shaped rollers having an outer rubber surface layer. Automatic paper feed apparatus 20 also includes a hopper 22, an edge guide 23, and a paper feeder tray 24**.

Hopper 22 includes a lower plate **22*a* for supporting a lower surface of a sheet of paper, side plates 22*b* integrally formed with lower plate 22*a* (only one side of which is shownby way of example in FIG. 1), triangular side plates 22*c* also integrally formed with lower plate 22*a* (only one side of which is shownby way of example in FIG. 1), and pins 22*d* integrally projected sideways from side plates 22*b* and 22*c*. Pins 22*d* engage with elongated slots 16*d* formed in side plate 16*c* of sub frame 16, thereby permitting hopper 22 to move diagonally upwardly and downwardly relative to sub frame 16. Hopper springs 25 are provided between hopper 22 and lower plate 16*a* of sub frame 16, and urge hopper 22 in a diagonally upward direction relative to sub frame 16. Furthermore, hopper springs 25 may be positioned essentially below (See FIG. 1) paper feed rollers 21*a* and 21*b*. A cam mechanism (not shown) is operatively connected to drive mechanism 100 and is positioned in side plates 16*c* and 16*c*' of sub frame 16 to push hopper 22 against the spring force of hopper springs 25. When paper is supplied, hopper 22 is pushed upwards by hopper springs 25, thereby pushing the paper towards paper feed rollers 21*a* and 21*b*. After the paper is fed to paper feed rollers 21*a* and 21*b*, hopper 22 is urged downward by the downward force provided by the cam mechanism, and moves downwardly with respect to paper feed rollers 21*a* and 21*b*, thereby preventing paper from being fed to paper feed rollers 21*a* and 21*b***.

Edge guide 23 includes a lower plate **23*a*, a bent portion 23*b* positioned in the leading edge portion of lower plate 23*a*, a clip portion 23*c* provided in the rear portion of edge guide 23, a side plate 23*d* connected to lower plate 23*a*, and a connecting plate 26. Edge guide 23 is slidably fitted onto hopper 22 by the engagement of bent portion 23*b* and a groove 22*e* in lower plate 22*a*. Clip portion 23*c* wraps over the rear portion (the upper end portion) of hopper 22 and holds edge guide 23 in place. Side plate 23*d* of edge guide 23 aligns the left edge of a sheet of paper (not shown) set in the top of hopper 22. The right side of the paper is guided by the upper portion inside surface of side plate 16*c*' on the right side of sub frame 16**.

As shown in FIG. 1, paper feeder tray 24 is detachably fitted to printer body 10 by an insertion piece **24*a* formed in the lower portion of paper feeder tray 24. Insertion piece 24*a* is inserted into insertion slot 11*a* provided in case 11 of printer body 10. With paper feeder tray 24 inserted into case 11, paper feeder tray 24 cooperates with hopper 22 to support the lower surface of a sheet of paper. When the automatic paper feeder apparatus is not operating, i.e., when hopper 22 is in a pushed-down state caused by the previously described cam mechanism, the operation for setting paper in automatic paper feeder apparatus 20 requires the insertion of one or more sheets of paper from an upward direction into paper feeder tray 24**.

When the automatic paper feeder apparatus 20 is operating with the paper set in paper feeder tray 24, the cam mechanism releases pressure in hopper 22 and causes hopper 22 to be urged upwardly by hopper springs 25. This upward movement by hopper 22 brings into contact only the uppermost sheet of paper in hopper 22 with paper feed rollers 21 and 21*b*. In this manner, a single sheet of paper is conveyed to paper feed path PP.

As shown in FIG. 2, a paper feed roller shaft 31 is rotatably supported by side frames 13 and 14 and is rotatably driven by drive mechanism 100. Paper feed rollers 30 are preferably two comparatively long, round, rod-shaped rubber rollers, rotatably mounted on paper feed roller shaft 31. When shaft 31 is driven by drive mechanism 100, shaft 31 and paper feed rollers 30 rotate and cause the paper to advance one line at a time. Prior to each advancement of the papers, head 60 and drive mechanism 100 cooperate so that head 60 moves across the sheet of paper and is positioned for printing the next line of print.

Figure 3:
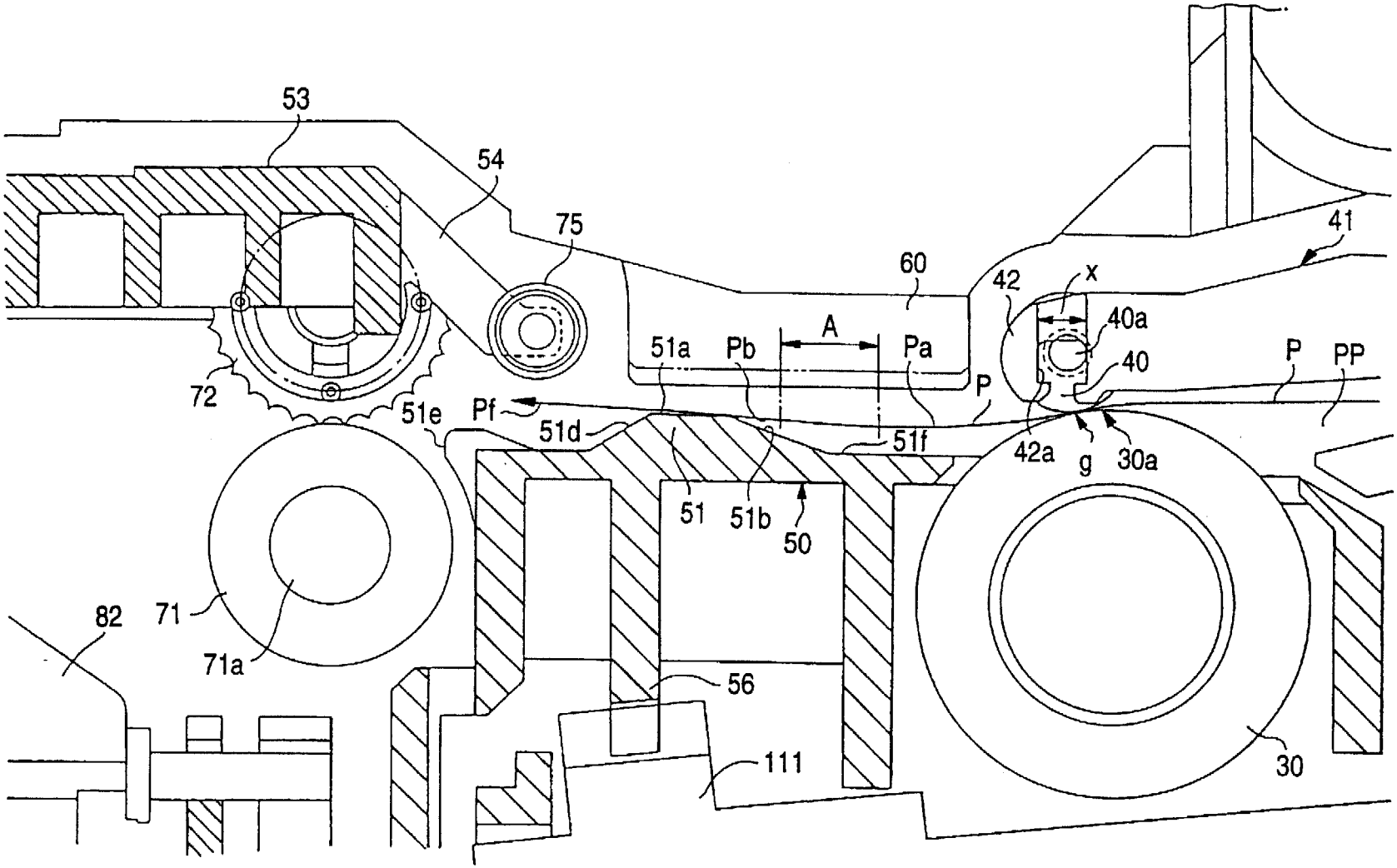
FIG. 3 is an enlarged sectional view of a portion of the ink jet printer constructed in accordance with the invention.

As shown in FIG. 3 in greater detail, holders 41 which include integrally formed cam portions 42, function as paper guides and form the upper portion of paper feed path PP. As shown in FIGS. 1 and 2, a pair of hooks 44 are formed in the upper portion of holders 41. These hooks support holders 41 in position on intermediate frame 15 such that holders 41 are capable of oscillation. Rectangular holes 42*a* are formed in portions 42 of holders 41. A shaft 40*a* is rotatably supported and capable of shifting in the directions of double headed arrow X within rectangular holes 42*a*. Pinch rollers 40 are preferably round, rod-shaped metal rollers, are supported on shaft 40*a* and oppose paper feed rollers 30. In a preferred embodiment, four pinch rollers are provided for each paper feed roller 30. Springs 45 are provided between holders 41 and intermediate frame 15. As shown in FIG. 3, pinch rollers 40 abut paper feed rollers 30 at a position g, which is slightly downstream in the paper- conveying direction from a position indicated as the top, 30*a*, of paper feed rollers 30. This slight forward alignment of pinch rollers 40, caused by the urging force of springs 45, along with the way shaft 40*a* is supported (see above), allows pinch rollers 40 to abut paper feeder rollers 30 with an automatic center-regulation function when pinch rollers 40 are rotatably driven by paper feed rollers 30.

A regulating member 50 is fixed in lower portion frame 12 and arranged on the bottom surface-side of a paper P conveyed by paper feed rollers 30. Regulating member 50 includes a horizontal flat portion 51*f* positioned opposite print head 60 and a plurality of ribs 51 integrally projected in an upward direction from horizontal portion 51*f*. Ribs 51 extend perpendicular to the paper-conveying direction, and have an inclined surface 51*b*, a top surface 51*a* connected to inclined surface 51*b*, and declined surface 51*d* connected to top surface 51*a*. When viewed from the side as shown in FIG. 3, these surfaces form a substantially trapezoidal profile and elongate in the paper-conveying direction.

Inclined surface 51*b* guides the leading edge of a paper fed by paper feed rollers 30. Top surface 51*a* abuts the bottom surface Pb of the paper and regulates the gap between the paper P and ink jet head 60. Guide portion 51*e* is provided on the upstream side of discharge rollers 71 and 72 and positioned downstream of ribs 51. Guide portion 51*e* guides the leading edge Pf of paper P toward discharge rollers 71 and 72, and is preferably only provided on the upstream side of discharge rollers 71 and 72.

As shown in FIG. 1, guide shaft 62 and upper edge 15*a* of intermediate frame 15 support and guide carriage 61. Ink jet head 60 is mounted on carriage 61. Carriage 61 moves reciprocally in a direction perpendicular to the paper-conveying direction by a drive force from a carriage motor (not shown). A monochrome ink tank 63 and a color ink tank 64 may both be installed on carriage 61 next to each other in a direction perpendicular to the paper-conveying direction so that ink jet head 60 is capable of color printing.

Figure 18A:
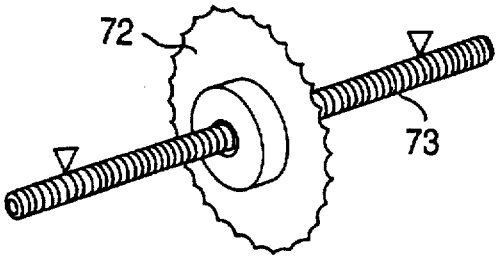
FIGS. 18A and 18B are perspective views of a serrated roller constructed in accordance with the present invention.
Figure 18B:
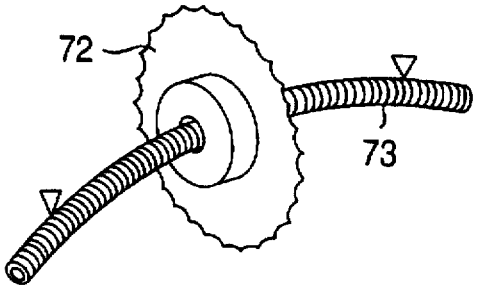

As shown in FIG. 2, a shaft 71*a* is rotatably supported in a side plate 52 of regulating member 50. A plurality of pairs of discharge rollers 71 and 72 (7 pairs are depicted in FIG. 2) are arranged along the width of the paper feed path. Rollers 71 are rotatably mounted on shaft 71*a*. Roller 71 of one end of the pairs of discharge rollers 71 and 72 is preferably constructed of a rubber roller and is rotatably driven by drive mechanism 100 by a transmission mechanism (not shown). Rollers 71 contact rollers 72, which may be thin plate-shaped, star wheels, but are preferably rotatably driven, serrated rollers. As depicted in FIG. 18A, each serrated roller 72 is rotatably supported on a round, rod-shaped coil spring 73 (which acts as a shaft) and is supported by a support plate 53 mounted in the printer body (see FIGS. 3 and 14). Serrated roller 72 contacts roller 71 by the spring force of coil spring 73. In the case of thick paper such as envelopes, serrated roller 72 does not press hard against the paper so as to impede the paper conveyance operation, but rather, rises upwards as shown in FIG. 18B. The rotational speed of the pairs of discharge rollers 71 and 72, which directly corresponds to the conveying speed of the paper, is set so that the linear speed of the paper through discharge rollers 71 and 72 is faster than the linear speed of the paper through paper feed rollers 30. As a result, when the leading edge of paper P reaches the discharge rollers 71 and 72, the paper is taut between the discharge rollers and the paper feed rollers.

Top surface 51*a* of ribs 51 of regulating member 50 is positioned slightly downstream of ink jet head 60 when viewed in the paper-conveying direction. This results in the paper P being urged towards the head 60. When the front and rear portions of paper P, pass over regulating member 50, they are conveyed while being urged downwardly toward regulating member 50 by paper feed rollers 30, pinch rollers 40, and discharge rollers 71 and 72. The bottom surface Pb of the paper reliably abuts the top surface 51*a* of the ribs 51.

Support plate 53 includes an arm 54 integrally formed and slanted downward therefrom. A guide roller 75 is rotatably mounted at the end of arm 54. Guide roller 75 is positioned between a printing section A and pairs of discharge rollers 71 and 72. In the undesirable situation where paper P is warped, the paper contacts guide roller 75 and is guided toward the pairs of discharge rollers 71 and 72. Guide roller 75 preferably has a small diameter and may be located close to head 60 so as to be capable of guiding a warped sheet of paper more accurately. Guide roller 75 is preferably formed of a water-repellent plastic and, as shown in FIG. 2, may be positioned such that it contacts a thick piece of paper, such as an envelope, midway across its width.

It is therefore clear from FIG. 1 that as paper P is supplied from automatic paper feeder apparatus 20, passes through concavely curved paper feed path PP, and reaches paper feed rollers 30, the feeding angle is regulated by pinch roller 40 as it is fed through paper feed roller 30. The leading edge of paper P is guided by regulating member 50, which also functions as a guide member. Paper P is guided such that its bottom surface Pb abuts the top surfaces of ribs 51*a*, formed on the upper surfaces of regulating member 50, and such that the gap between the surface of paper P and head 60 is regulated, while ink is discharged from head 60 onto the top surface Pa of paper P, and printing is carried out. The printed paper P passes through the pairs of discharge rollers 71 and 72 and discharge portion 120, and is discharged onto discharge tray 18.

Figure 11:
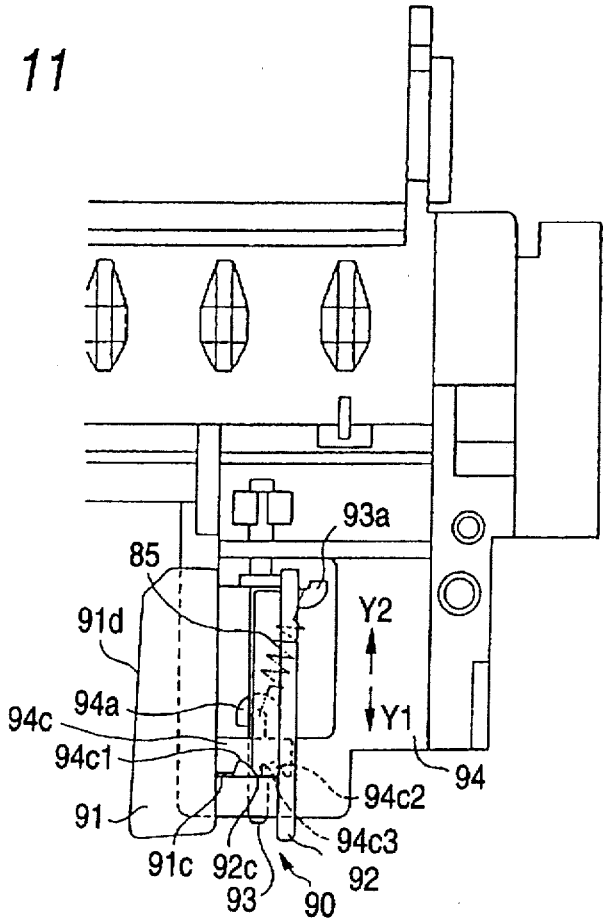
FIG. 11 is an enlarged top plan view of the right support constructed in accordance with the invention.

As shown in FIG. 2, discharge portion 120 includes a roller 19 for pushing the center of a paper downwards, a slider 84, which will be discussed below, and first and second support assemblies 80 and 90, which support from below, respective side portions of a paper discharged by pairs of discharge rollers 71 and 72. As shown in FIG. 11, support assembly 90, which will be discussed in greater detail below, includes a base portion 94, a shaft 93, and a first and second support member 91 and 92.

Figure 5:
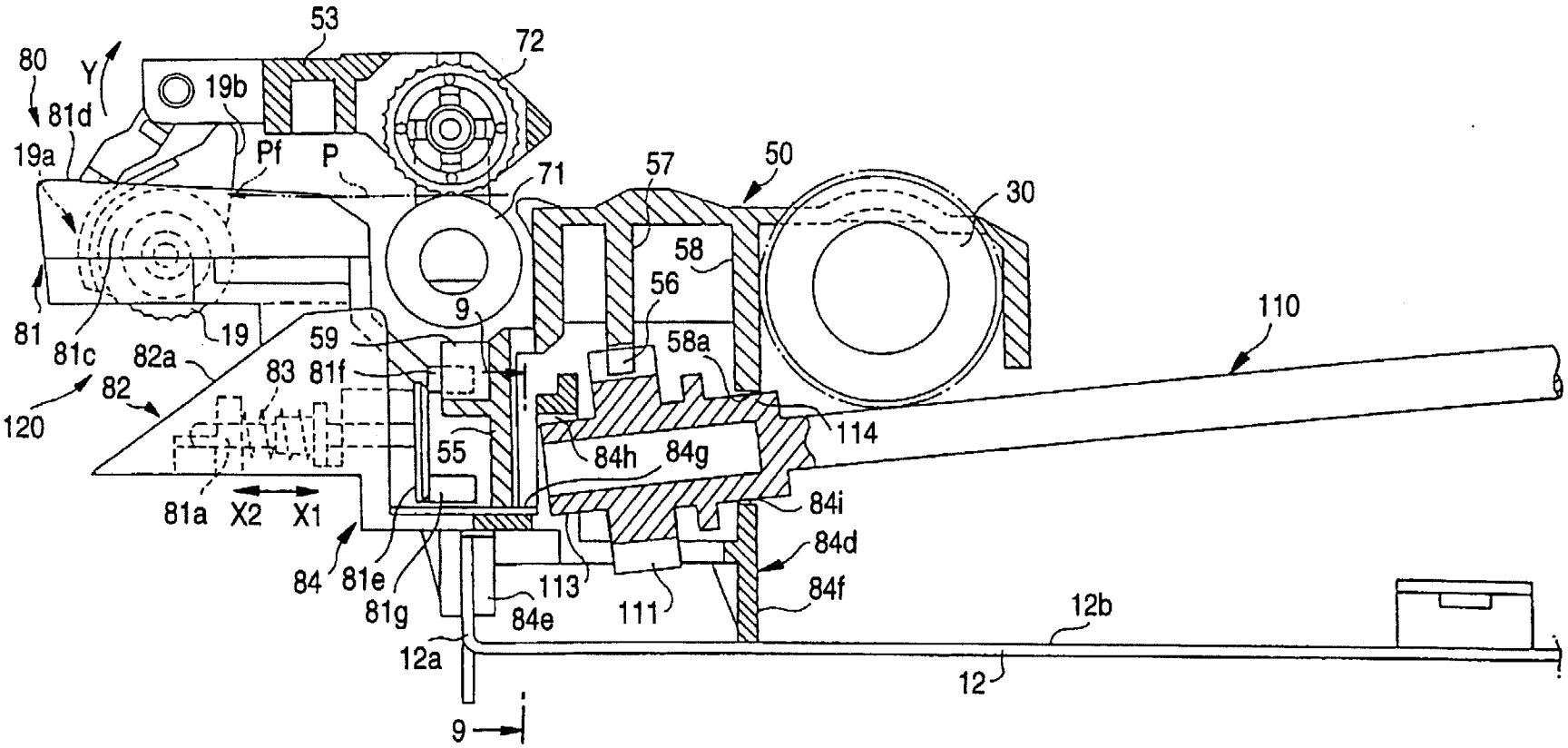
FIG. 5 is an enlarged fragmented sectional view of the printer constructed in accordance with the invention.
Figure 6:
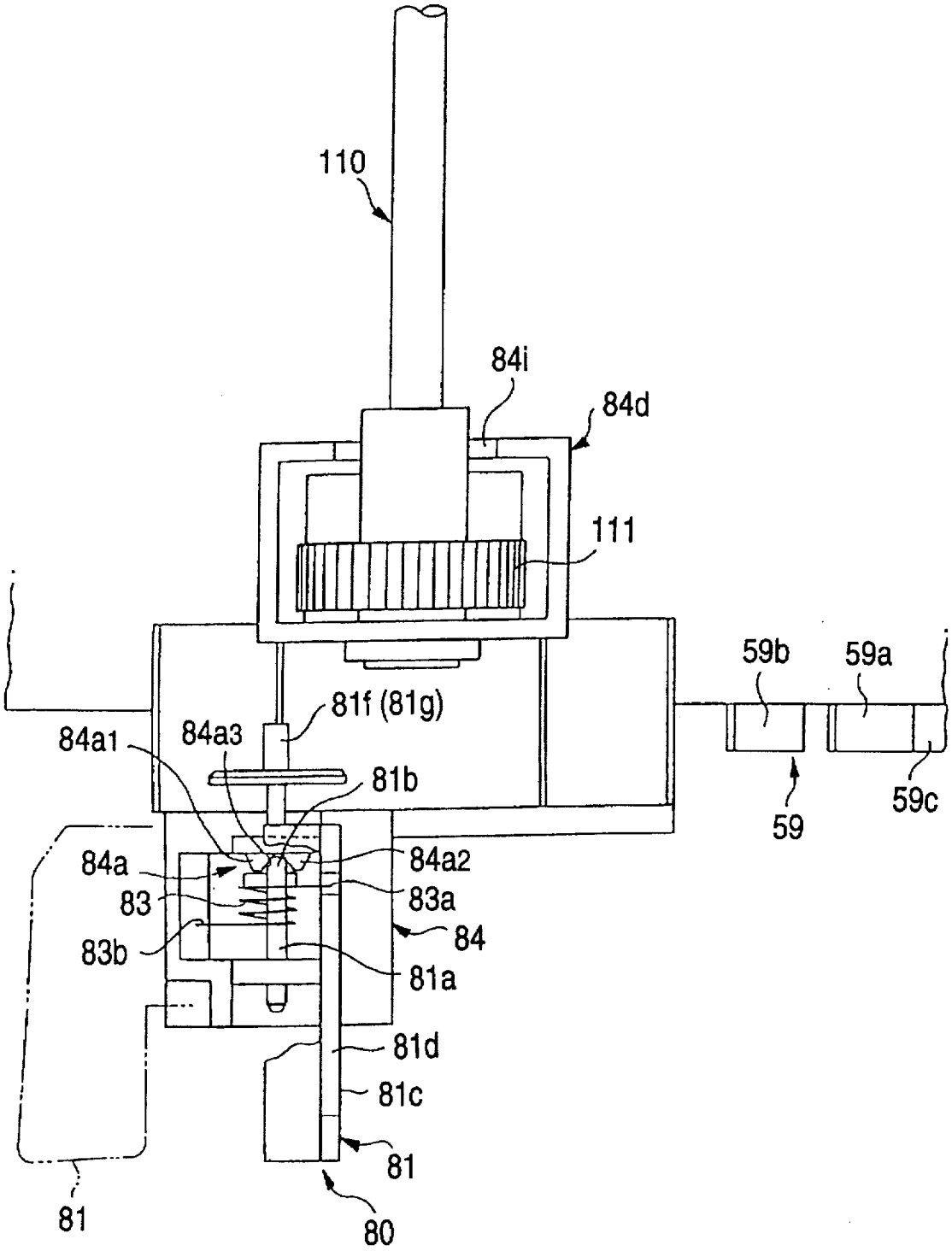
FIG. 6 is an enlarged top plan view of a portion of the printer constructed in accordance with the invention.
Figure 7:
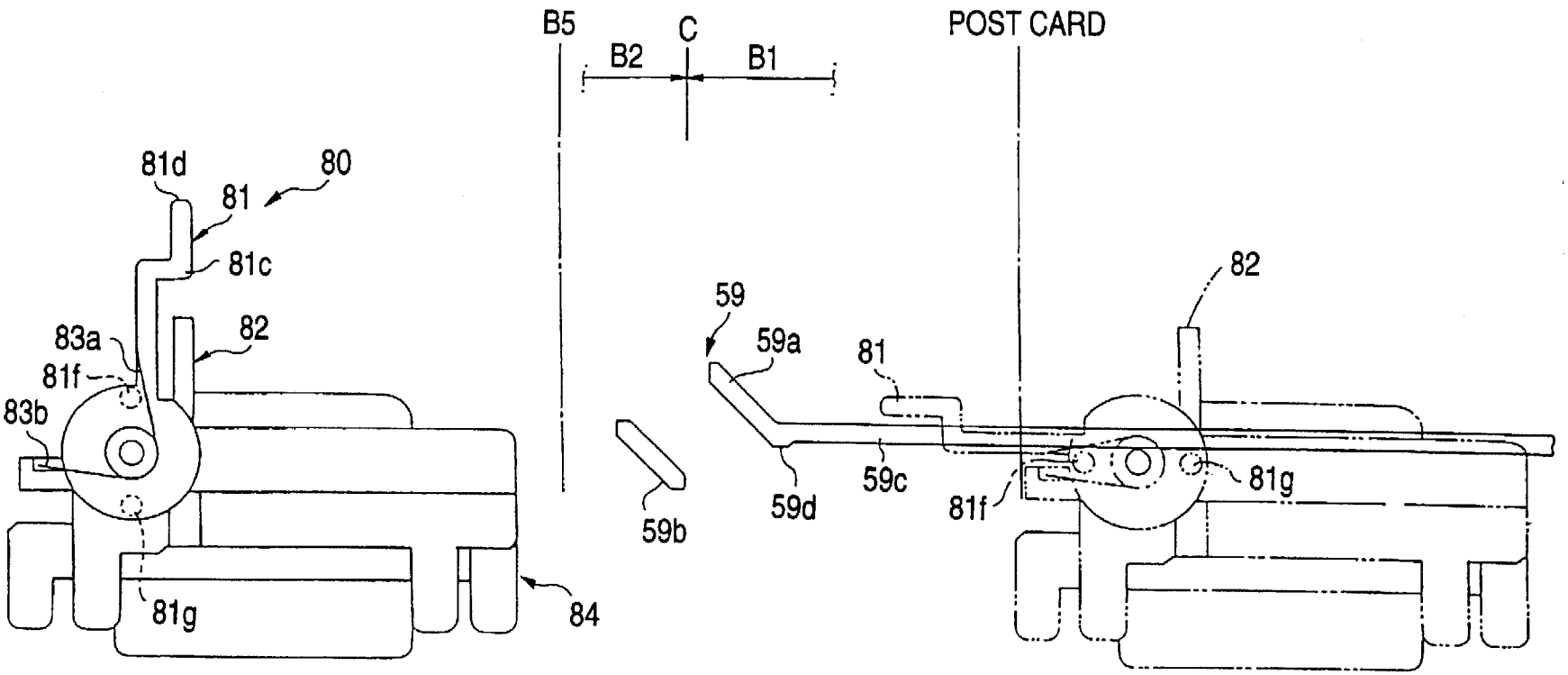
FIG. 7 is an enlarged front elevational view of a switch showing one support in the upright position and in a non-support position (in chain line) constructed in accordance with the invention.

Reference is now made to FIGS. 5–7 which depict sliding support assembly 80 of discharge portion 120 in greater detail. Support assembly 80 is mounted on slider 84 and is slidable in a direction perpendicular to (along the width of) the paper feed path PP. Support assembly 80 also includes a first and second support member 81 and 82, respectively. The first support member 81 is used for guiding and supporting from below a first end (as viewed from a leading edge of discharging paper) of relatively flexible paper, such as ordinary paper of A4 or B5 size, whereas second support member 82 is used for guiding and supporting the first end of relatively firm copying paper, such as envelopes and postcards.

As shown in FIGS. 5 and 6, shaft 81*a* is rotatably mounted to slider 84 and is integrally formed with first support member 81. Shaft 81*a* is capable of both rotation and displacement in either of the directions of arrows X1 and X2. A disk-like arm 81*e* is integrally formed at the rear end of shaft 81*a* of support member 81. An upper pin 81*f* and lower pin 81*g* are each integrally projected from the upper and lower rear portions of arm 81*e*. Shaft 81*a* is fitted with pull-spring 83, one end 83*a* of which is retailed by first support member 81, the other end 83*b* being retained by slider 84. Pull-spring 83 exerts a force on first support member 81 in the direction of arrow X1 and also urges first support member 81 in an upright position as is discussed below.

As shown in FIGS. 6 and 7, a detent or retaining portion 84*a* is formed in the upstream side of slider 84, and a lower portion 81*b* of first support member 81 engages with and disengages from detent portion 84*a* by a clicking operation. The detent portion 84*a* includes two protruding portions 84*a*1 and 84*a*2, and one recess portion 84*a*3, such that when lower portion 81*b* engages with recess portion 84*a*3 of detent portion 84*a*, support member 81 stands upright in the same way as support member 82. When a threshold force is applied to the upper portion 81*c* of support member 81 by a switch 59, which is described below, lower portion 81*b* is displaced from recess portion 84*a*3 of detent portion 84*a*, and simultaneously shaft 81*a* rotates in a counterclockwise direction and moves in the direction of the arrow X2 (see FIG. 5), thereby causing support member 81 to fall to a prone, non-supporting position. Support member 81 is shown in its upright and prone positions in FIGS. 6 and 7. The prone position of support member 81 is indicated by chain lines.

When first support member 81 turns by more than a predetermined angle, lower portion 81*b* abuts against the lower face of left protruding portion 84*a*1 of detent portion 84*a* to brace support member 81 in a prone position. That is, detent portion 84*a* also forms the retaining portion of support member 81. When a clockwise rotational force is applied by switch 59, which is described below, to shaft 81*a*, the first support member 81 stands upright in response to the force exerted by pull-spring 83. Lower portion 81*b* engages with recess portion 84*a*3 of detent portion 84*a* and maintains support member 81 in an upright position.

In the present embodiment, the upright position of support member 81 is a supporting position, where the side portions of a paper are supported from below. The prone position is a non-supporting position, where the side portions of a paper are not supported.

As shown in FIG. 5, the upper edge face 81*d* of support member 81 in the upright position forms a support face that gently slopes upward in the paper feed direction. The support face formed by upper edge 81*d* is situated slightly above the paper discharged by the pairs of paper discharge rollers 71 and 72 so as to guide the copying paper at a slightly upward angle.

Switch 59 is integrally formed on the front of defining member 50. As shown in FIG. 7, switch 59 is provided within the sliding range of slidable support assembly 80 and includes a first and second tilted plate 59*a* and 59*b* which form a camming surface acting as a guide body. Switch 59 is provided at a boundary position C between ranges B2 and B1. Range B2 corresponds to a range of paper widths at which the side portions of a paper need support by support member 81, while range B1 corresponds to a range of paper widths at which the side portions of a paper need no support. As shown in FIGS. 6 and 7, rail 59*c* extend from and is integrally formed at the lower end of first plate 59*a* to form an acute angle therewith. A protrusion 59*d*, integrally formed at the junction of first tilted plate 59*a* and rail 59*c*, protrudes slightly below rail 59*c*. First and second plates 59*a* and 59*b* are positioned so that they are offset slightly in the vertical direction from each other.

Figure 8A:
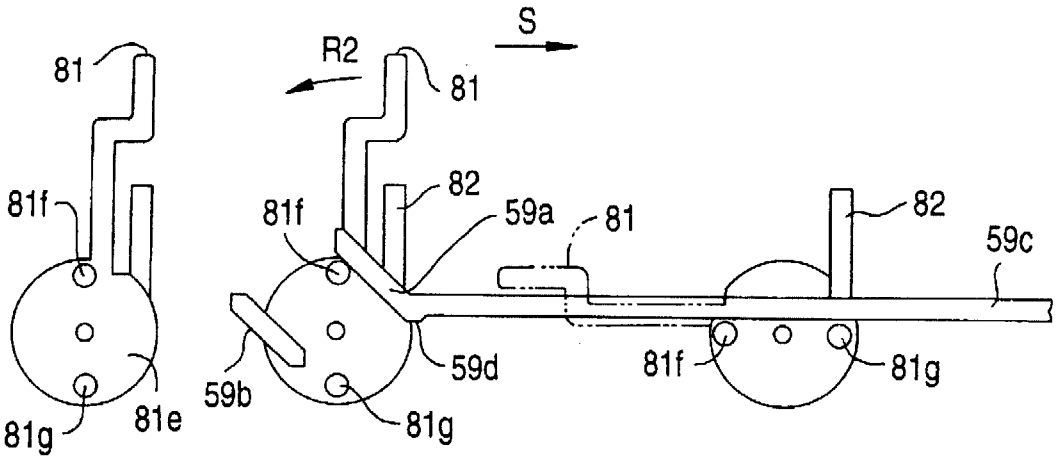
FIGS. 8A, 8B and 8C are enlarged schematic elevational views of one support means and the switch operating in accordance with the invention.

Referring to FIGS. 7 and 8, when slidable support assembly 80 is positioned within range B2 and is moved from the position shown by line B5 toward range B1 in the direction of arrow S, upper pin 81*f* passes above the second plate 59*b* and abuts against first plate 59*a* (see FIG. 8A), thereby causing first support member 81 to rotate counterclockwise in the direction of arrow R2 against the force of spring 83. At the time upper pin 81*f* climbs over protrusion 59*b*, first support member 81 is rotated to its maximum prone position, and as stated above, lower portion 81*b* of first support member 81 abuts against the lower face of left protruding portion 84*a*1 of detent portion 84*a*, such that support member 81 is lightly braced in the prone position. If a force is applied in the clockwise direction R1 to first support member 81, it is kept in the prone position by upper pin 81*f*, abuts against the lower face of rail 59*c*.

Figure 8B:
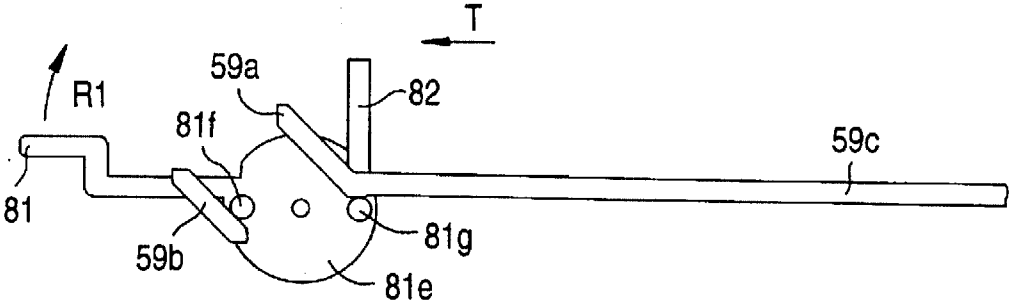
Figure 8C:
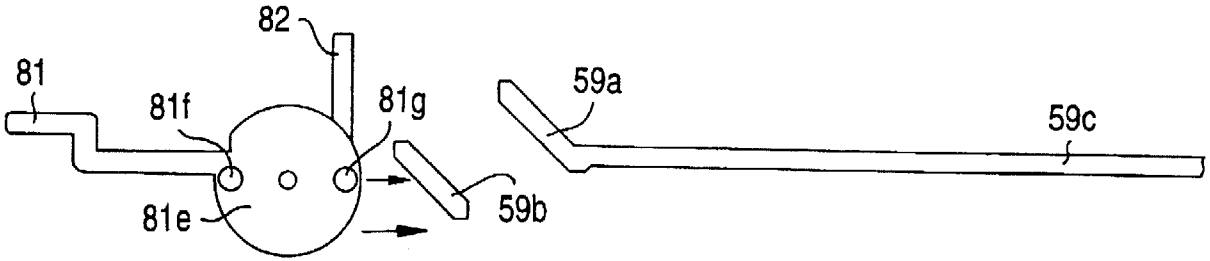

Conversely as shown in FIG. 8B, when slider 84 moves in the direction of arrow T towards B5, upper pin 81*f* passes under plate 59*a* and abuts against second plate 59*b*, and support assembly 80 moves from range B1, where support is not required, to range B2, where support is required. At this point, upper pin 81*f* no longer abuts the lower face of rail 59*c*, and support member 81 rotates clockwise in the direction of arrow R1 to the upright position. Thus, first support member 81 automatically becomes prone or upright as left support assembly 80 is moved from side to side. As will be described later, as shown in FIG. 8C, first support member 81 may be manually placed in the fallen position when it is situated to the left of plate 59*b* as viewed in FIG. 7.

As shown in FIG. 5, second support member 82 includes an upright piece, which is integrally formed with slider 84 and has a support face 82*a* that slopes downward in the downstream direction of the paper feed path and supports paper discharged from the pairs of discharge rollers 71 and 72. As shown in FIG. 7, first support member 81 is crank-like in form, such that when it is in the upright condition, its upper portion 81*c* is located above second support member 82. Therefore, discharged paper is supported by first support member 81 when the first support member 81 is in an upright position, as shown in FIG. 8A, and is supported by second support member 82 when first support member 81 is in the fallen position, as shown by FIG. 8B.

Figure 9:
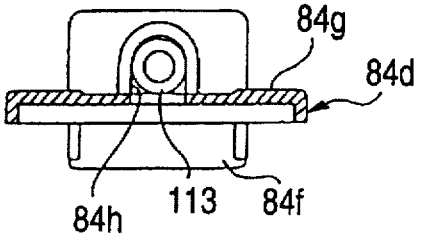
FIG. 9 is a sectional view taken along line 9—9 of FIG. 5.

As depicted in FIGS. 5 and 9, slider 84 is slidably mounted to lower portion frame 12. Slider 84 includes a base portion 84*d* in the rear portion thereof, fitting portion 84*e* which is slidably mounted onto bent portion 12*a* in the front portion of lower portion frame 12, and a leg portion 84*f* formed in base portion 84*d* and guided by the top surface 12*b* of lower portion frame 12. Slider 84 is slidably supported with respect to lower portion frame 12 by fitting portions 84*e* and leg portion 84*f*. An upper surface 84*g* of base portion 84*d* is slidably supported by the lower surface of a front plate 55 of regulating member 50.

Sliding support assembly 80 is operatively linked to edge guide 23 of automatic paper feeder apparatus 20 by a linking mechanism. The linking mechanism includes a linkage rod 110. A first pinion 111 is integrally formed at one end (support assembly side) of linkage rod 110. A second pinion 112 (FIG. 1) is integrally formed at a second end (edge guide side) of linkage rod 110. A first rack 56 is formed on a lower surface of hanging piece 57 of regulating member 50 and engages with first pinion 111. A second rack 16*f* (FIG. 1) is formed in the rear portion of lower surface 16*a* of sub frame 16 and engages with second pinion 112.

As shown in FIGS. 5 and 9, a linkage rod leading end 113, which is the front portion of first pinion 111, is rotatably supported in a shaft reception hole 84*h* formed in base portion 84*d* of slider 84. That is, a rear portion 114 of first pinion 111 is rotatably supported by a rear portion upper surface 84*i* of base portion 84*d* and a lower surface 58*a* of hanging piece 58 of regulating member 50. The rear portion 114 of first pinion 111 is slideable with respect to lower surface 58*a* of hanging piece 58 of regulating member 50 in a direction perpendicular to the paper feed direction.

Figure 10:
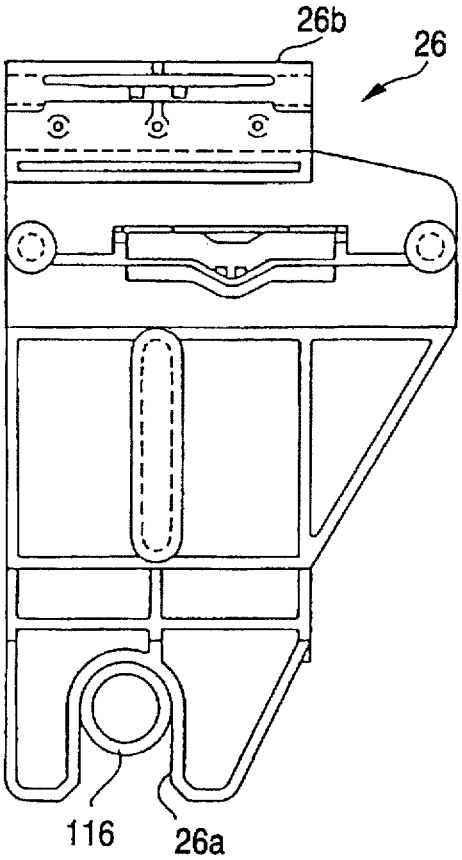
FIG. 10 is a rear elevational view of a connection plate constructed in accordance with the present invention.

As further shown in FIG. 1, a rear end 115 of linkage rod 110 is rollably supported by a lower portion of a bent portion 16*g* of back plate 16*b*. Rear end 115 of linkage rod 110 is movable by the engaging force of second pinion 112 and second rack 16*f*. Next, as shown in detail in FIG. 10, a recess portion 26*a* is formed in a lower portion of connecting plate 26. A rear portion 116 of second pinion 112 is rotatably supported within recess portion 26*a*.

In this way, the rear portion of linkage rod 110 is rotatably connected to edge guide 23. Specifically, upper portion 26*b* of connecting plate 26 is coupled to edge guide 23 and moves together therewith. Therefore, when paper is set in automatic paper feeder apparatus 20 and edge guide 23 is moved in a direction perpendicular to the paper feed direction, the movement of edge guide 23 is translated to second rack 16*l* through the above-described linkage. In turn, second rack 16*f* engages with second pinion 112 of linkage rod 110, thereby causing linkage rod 110 and first pinion 111 to rotate. Finally, first pinion 111 engages with first rack 58. In this manner, the leading end 113 of linkage rod 110 does not receive any influence from the bending of linkage rod 110. That is, leading end 113 moves essentially the same distance as rear end 115, and slider 84 and left support assembly 80 moves the same distance as edge guide 23 (shown in chain line in FIG. 2). Accordingly, when edge guide 23 is slid, left support assembly 80 is slid; that is, edge guide 23 and support assembly 80 are properly aligned by one operation-moving edge guide 23.

When left support assembly 80 passes by switch 59 during its movement, first support member 81 is automatically placed in the prone or upright condition. As stated above, discharged paper is supported by first support member 81 while first support member 81 is in the upright position as shown by the solid line of FIG. 7 and is supported by second support member 82 while first support member 81 is in the prone position, as shown by the chain line thereof. Whether the support edge of the discharged paper is supported by first support member 81 or second support member 82 is determined selectively in accordance with the width of the copying paper by manually setting edge guide 23 at an appropriate guide position.

According to this embodiment, the position of switch 59 is set as shown in FIG. 7, such that first support member 81 is in an upright, supporting position when paper of B5 size is placed in paper feed tray 24 (represented by dashed line B5) and first support member 81 is in the prone position when a post card is placed in paper feed tray 24 (represented by dashed line "post card"). In other words, according to this embodiment, in the event that paper feed tray 24 contains paper of B5 size, and the user desires to replace it with a post card, edge guide 23 is slid to a position that agrees with the size of the post card, and first support member 81 automatically falls to the prone position to allow second support member 82 to support the discharged post card. As will be described later, moreover, first support member 81 may be manually placed in the prone position when, for example, envelopes exceeding B5 in size are printed upon. When paper of B5 size is printed, edge guide 23 is slid to the range B1 and support assembly 80 interlocked therewith simultaneously slides to the B1 range causing lower pin 81*g* of first support member 81 to abut against second plate 59*b*. In this way, first support member 81 automatically assumes an upright position.

According to this embodiment, a third plate (not shown) similar to second plate 59*b* is provided in a position corresponding to A4 paper size. When edge guide 23 is slid so as to print on paper of A4 size after printing an envelope that exceeds A4 size by manually placing first support member 81 in the prone position, left support assembly 80 and edge guide 23 simultaneously slide to the right, and lower pin 81*g* of first support member 81 abuts against the third plate, causing first support member 81 to automatically assume an upright position.

Figure 12:
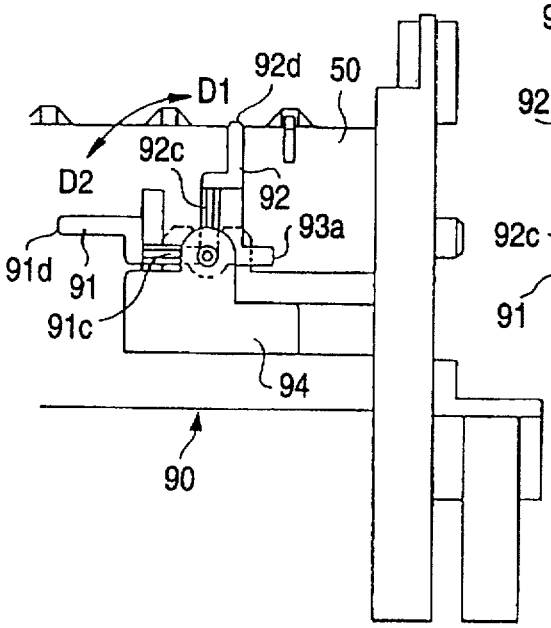
FIG. 12 is an enlarged elevational view of the right support constructed in accordance with the invention.
Figure 13:
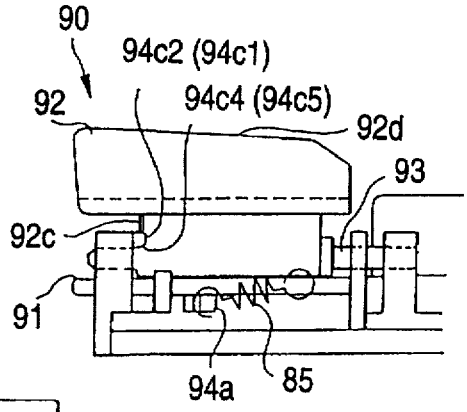
FIG. 13 is an enlarged sectional view of the right support constructed in accordance with the invention.

As shown in FIGS. 11–13, a second support assembly 90 for supporting the second edge of paper, opposite the edge supported by first assembly 80, includes a base portion 94. A shaft integrally formed with a first support member 91 is slidably mounted to base 94. A second support member 92 is mounted to base 94. First support member 91 guides and supports the second edge of flexible paper, such as ordinary paper of A4 or B5 size. Second support member 92 guides and supports the second edge of relatively firm paper, such as envelopes or post cards. Second support member 92 is integrally formed with shaft 93. Shaft 93 is capable of both rotation and displacement in either direction of arrows Y1 and Y2 of FIG. 11). Base portion 94 is integrally formed with defining member 50. A hook 93*a* is provided integrally with shaft 93 and hook 94*a* is integrally provided with base portion 94. A pull-spring 85 is provided between hook 93*a* and hook 94*a* to urge shaft 93 in the direction of arrow Y1. A retaining portion 94*c* is formed on the front of base portion 94. The detent portion 94*c*, as shown in FIG. 11, includes two protruding portions 94*c*1 and 94*c*2, and one recessed portion 94*c*3. Lower portion 91*c* of first support member 91 and lower portion 92*c* of second support member 92 are detachably mounted to detent portion 94*c* by a clicking operation.

When second support member 92 is in an upright position, its lower portion 92*c* mates with recessed portion 94*c*3 of detent portion 94*c*, as shown in FIG. 11, and lower portion 91*c* of first support member 91 abuts against the lower face 94*c*4 of protruding portion 94*c*1, so that this condition is held. When a force is applied to first support member 91 and second support member 92 in a direction perpendicular to the paper feed path, prior to the support members being rotated in the direction of arrow D1 of FIG 12, lower portion 91*c* of first support member 91 is released from lower face 94*c*4 of protruding portion 94*c*1 and, at the same time, lower portion 92*c* of second support member 92 is released from recessed portion 94*c*3 of detent portion 94*c*, thereby allowing shift 93 to move in the direction of arrow D2 and oppose the spring force created by pull-spring 85. When shaft 93 rotates to a position where lower portion 91*c* of first support member 91 reaches recessed portion 94*c*3 of detent portion 94*c*, lower portion 91*c* mates with recessed portion 94*c*3 of detent portion 94*c* and lower portion 92*c* of second support member 92 mates with lower face 94*c*5 of protruding portion 94*c*2 of detent portion 94*c*, so that this position is held (see FIG. 11). Similarly, when a force is applied to first support member 91 and second support member 92 in a direction perpendicular to the paper feed path, prior to the support members being rotated in the direction of arrow D2, lower portion 92*c* is released from lower portion 94*c*5 of detent portion 94*c* and lower portion 91*c* is released from recessed portion 94*c*3 of protruding detent portion 94*c*, thereby allowing shaft 93 to move in the direction of arrow D2.

As first and second support members 91 and 92 are different heights (FIG. 14), when first support member 91 is in the upright position, discharged paper is guided and supported by relatively high support face 91*d*. When second support member 92 is in the upright position, as shown in FIG. 12, discharged paper is guided and supported by relatively low support face 92*d*.

Figure 14:
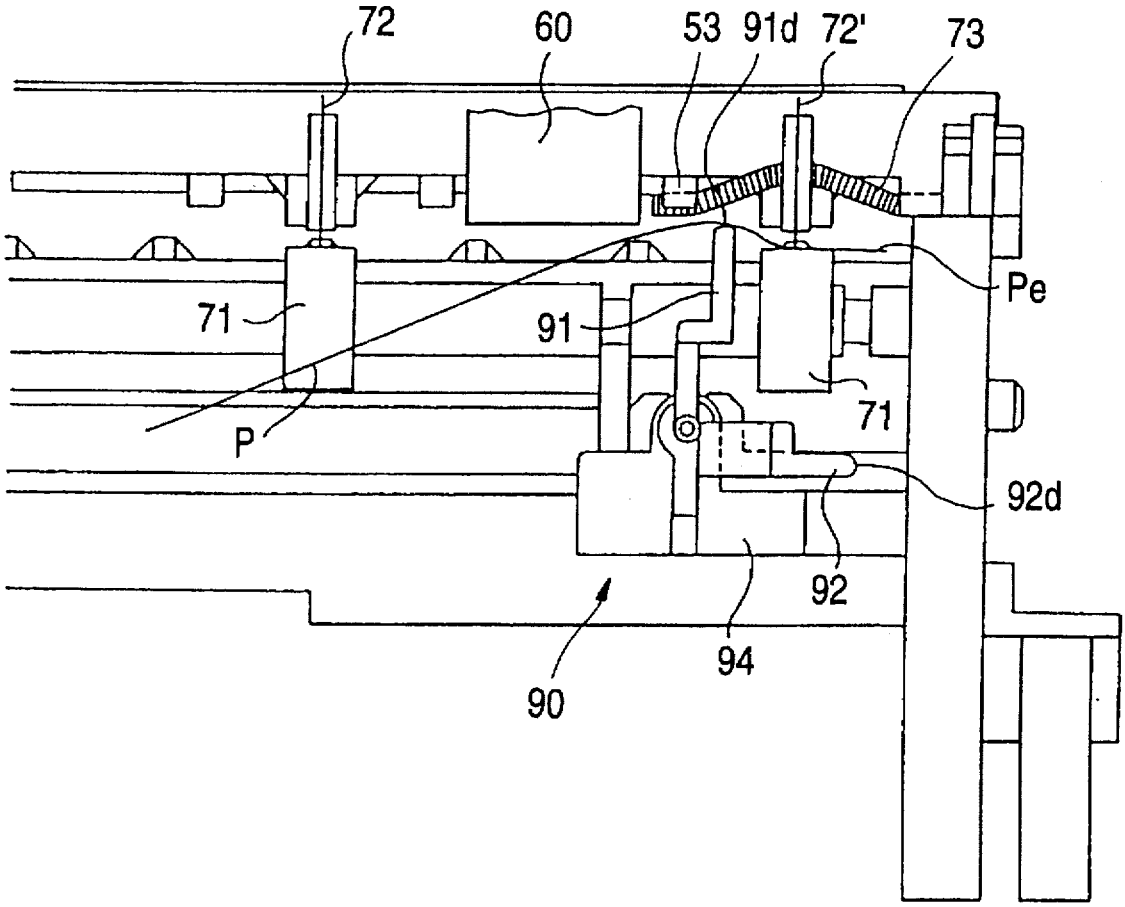
FIG. 14 is an enlarged elevational view of the right support and a discharge roller constructed in accordance with the present invention.
Figure 25:
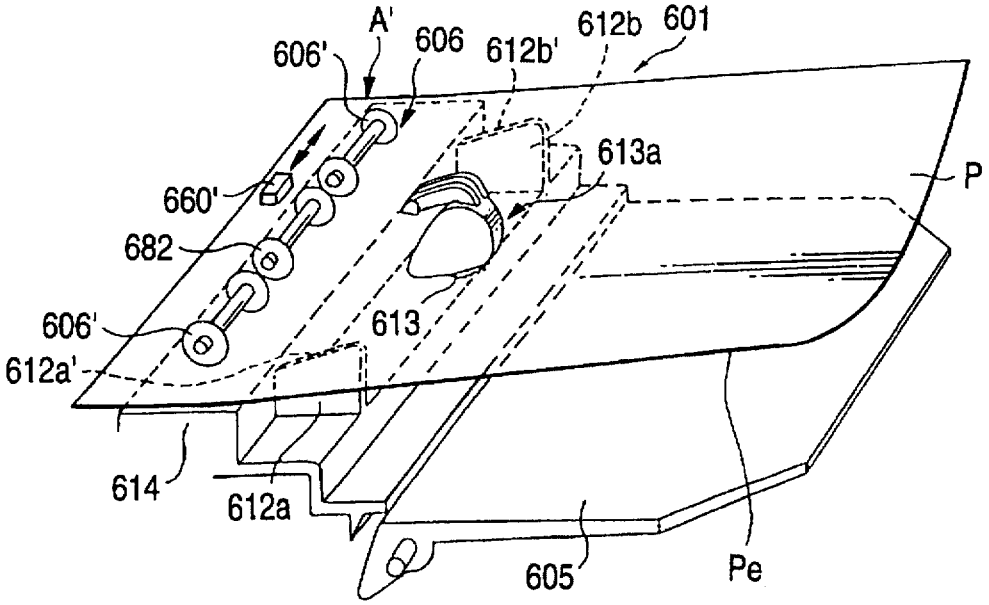
FIG. 25 PRIOR ART
FIGS. 25–36 depict printers constructed in accordance with the prior art.
Figure 26:
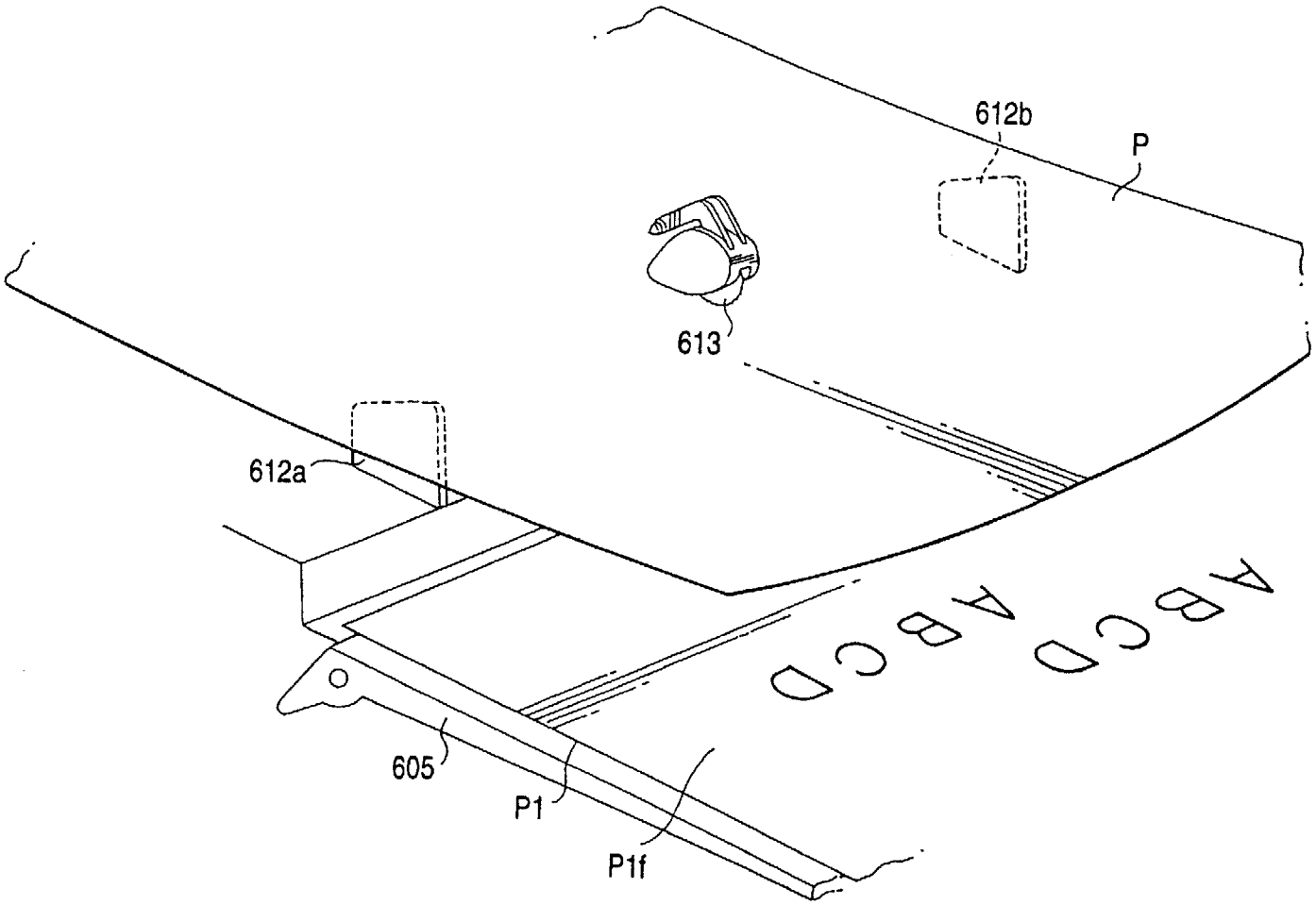
FIG. 26 PRIOR ART
Figure 27:
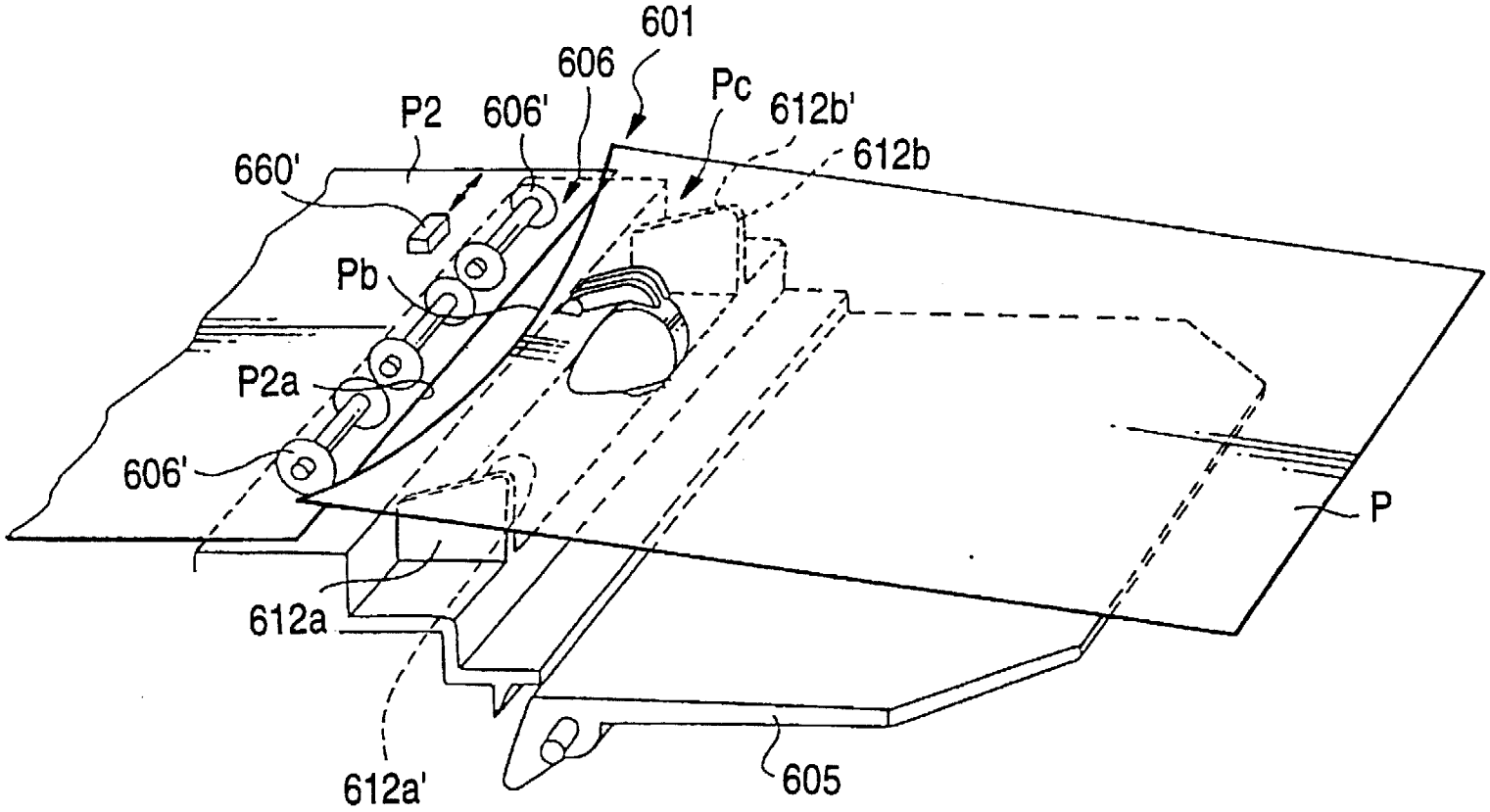
FIG. 27 PRIOR ART
Figure 28:
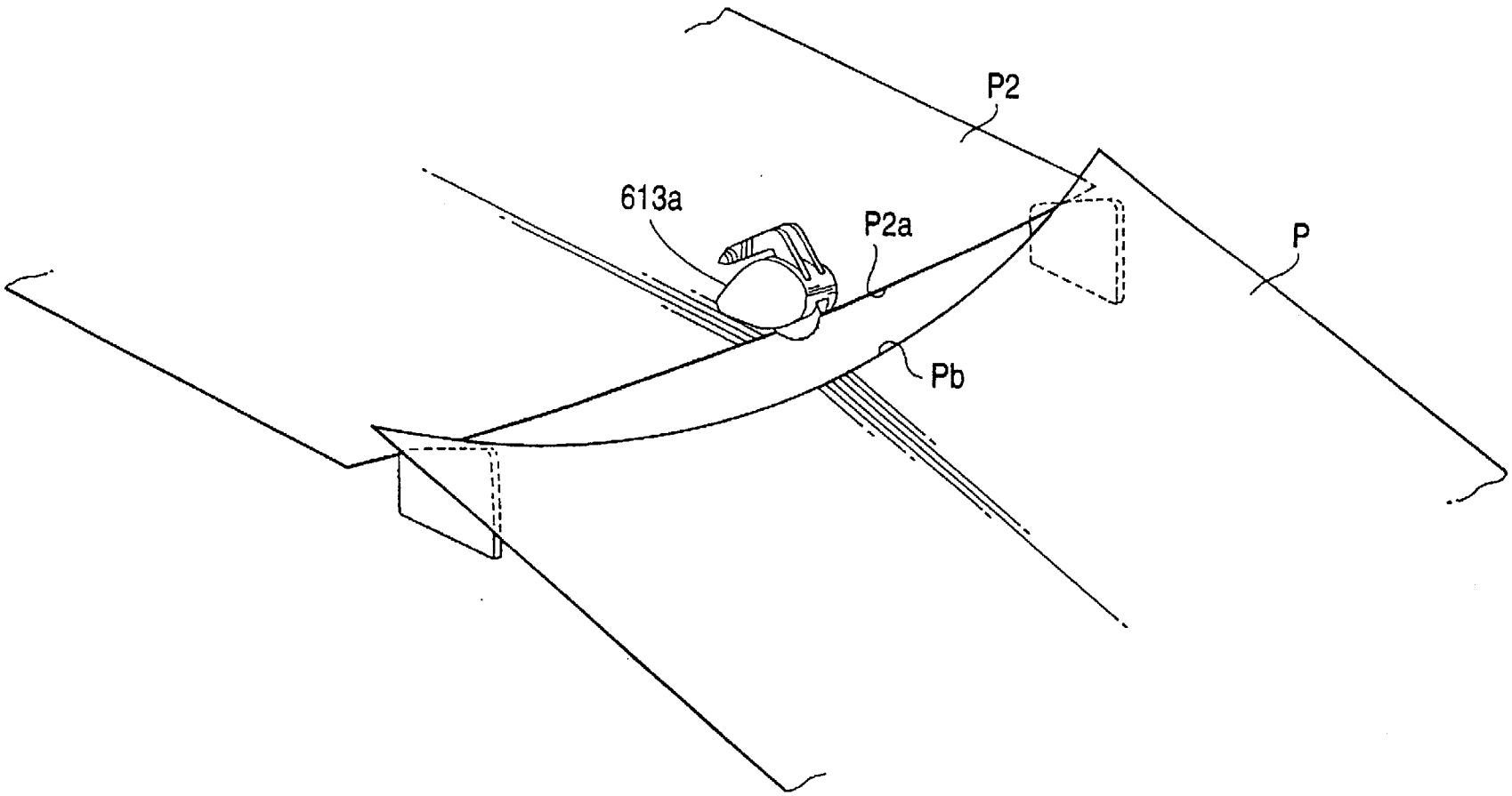
FIG. 28 PRIOR ART
Figure 29:
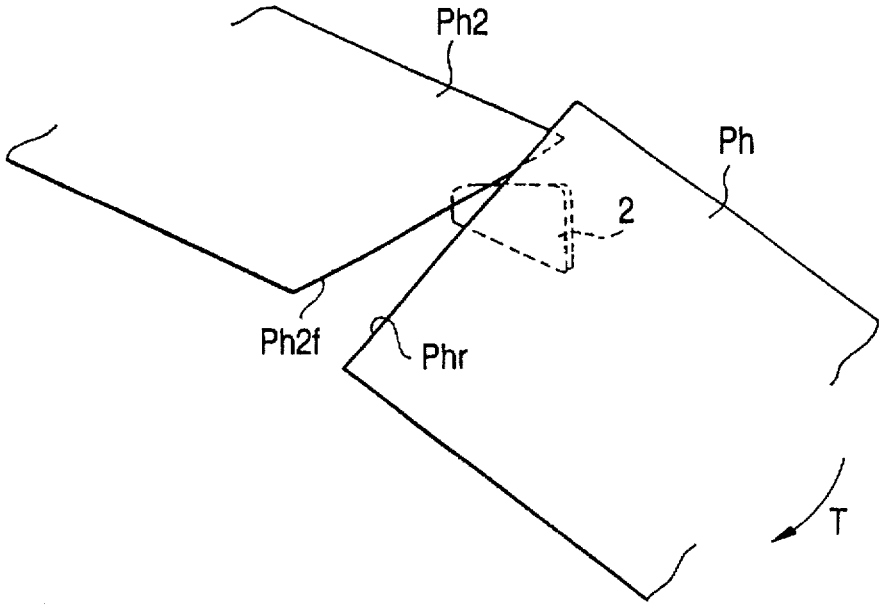
FIG. 29 PRIOR ART
Figure 30:
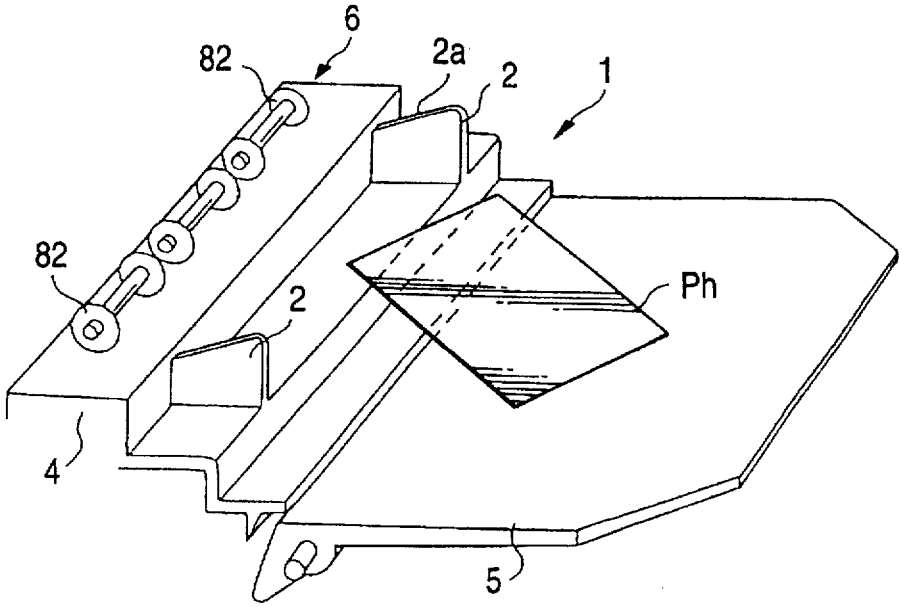
FIG. 30 PRIOR ART
Figure 31:
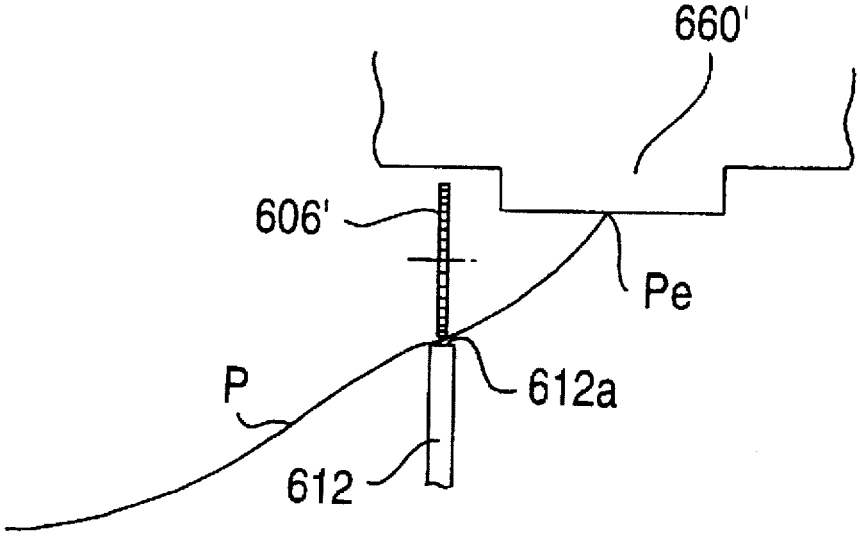
FIG. 31 PRIOR ART
Figure 32:
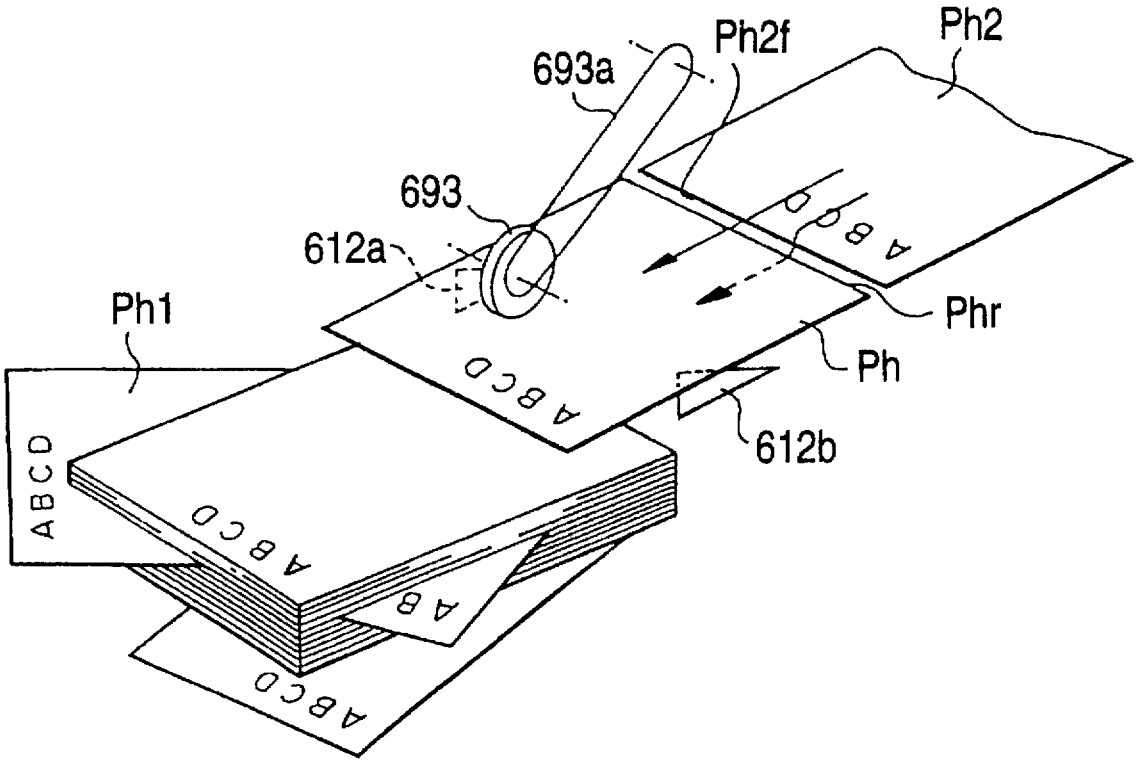
FIG. 32 PRIOR ART
Figure 33:
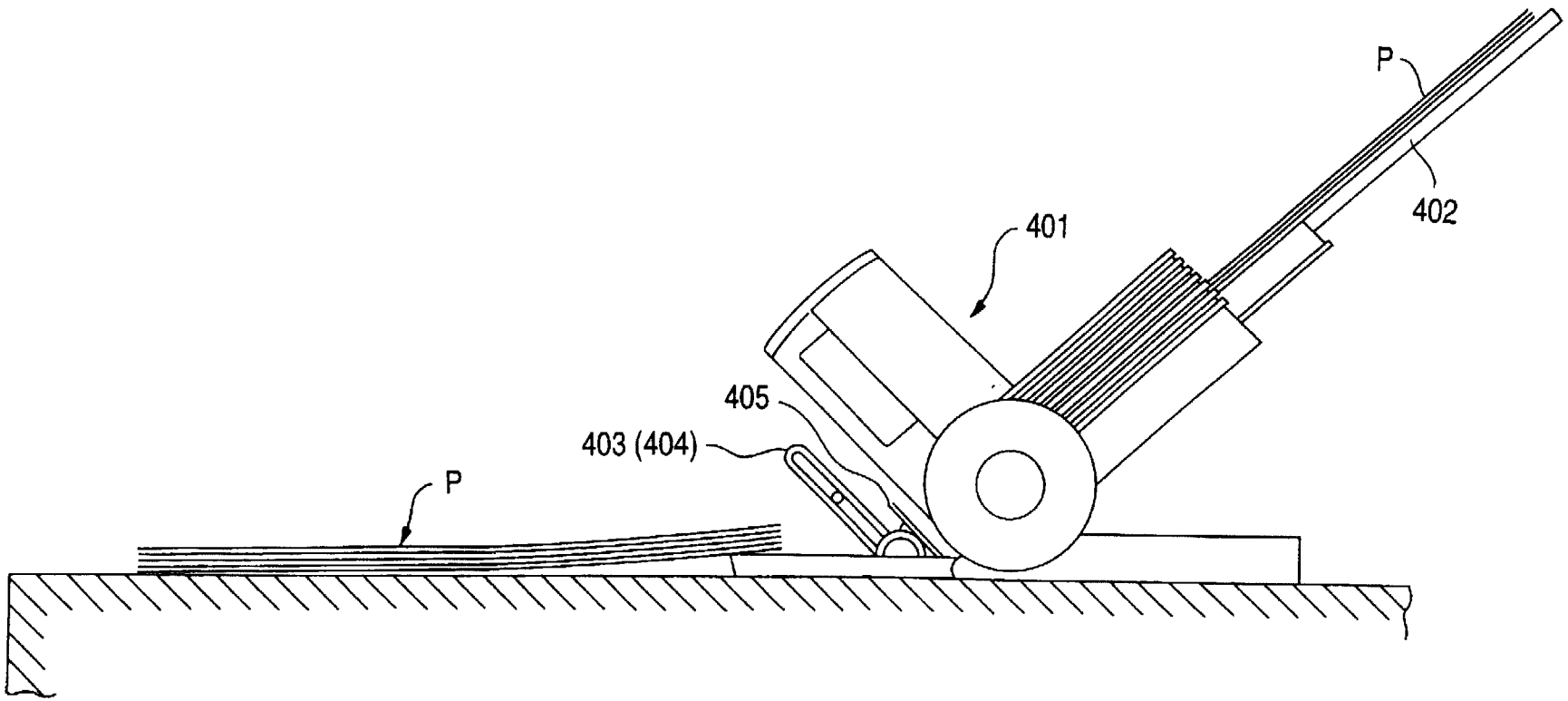
FIG. 33 PRIOR ART
Figure 34:
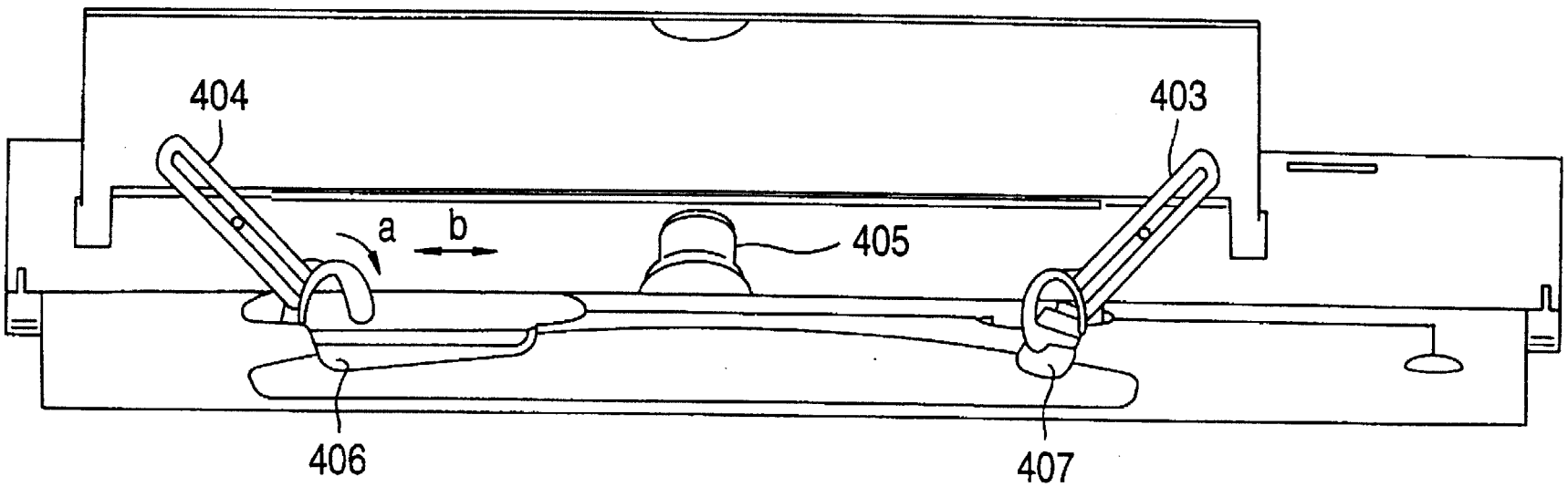
FIG. 34 PRIOR ART
Figure 35:
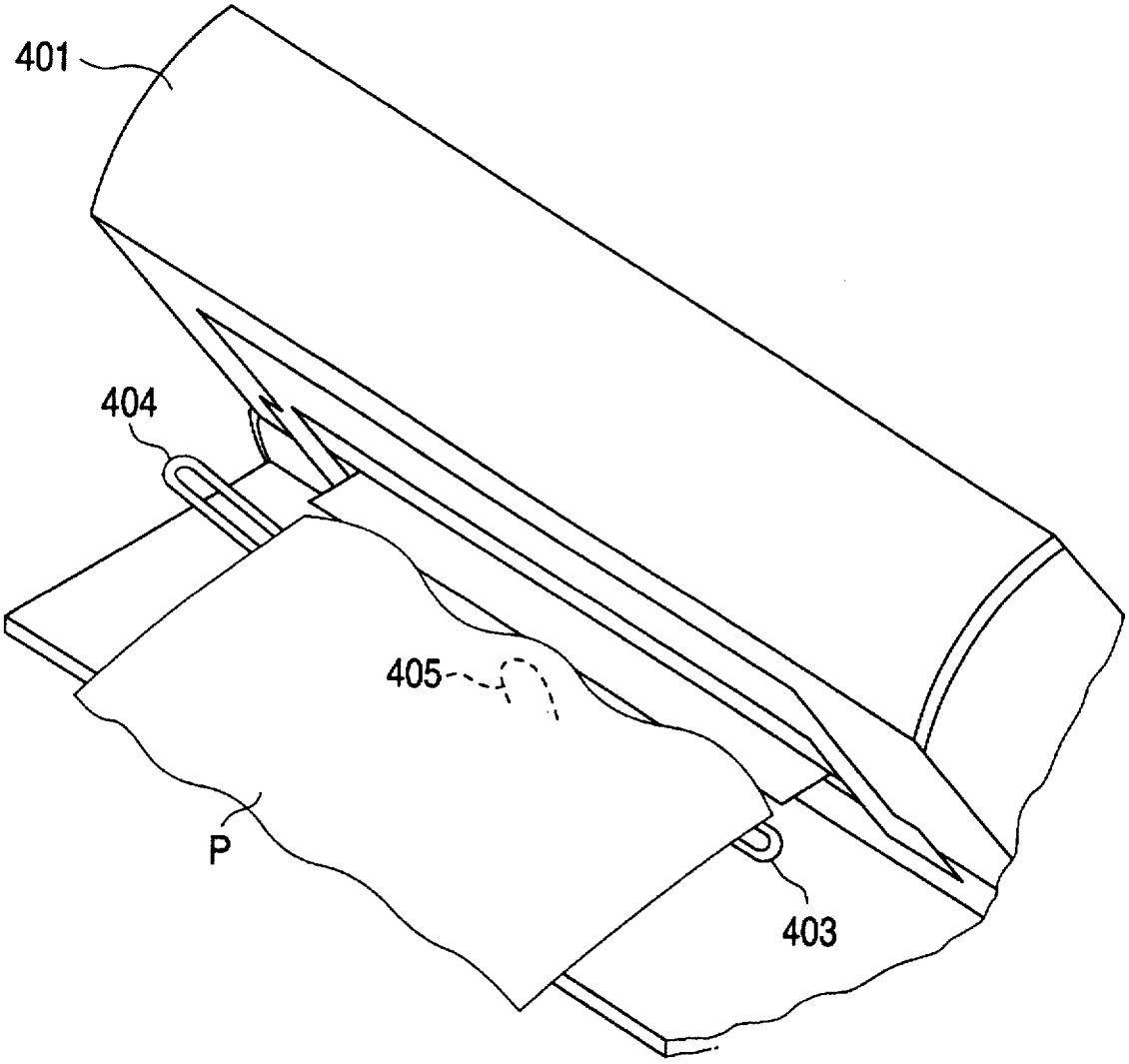
FIG. 35 PRIOR ART
Figure 36:
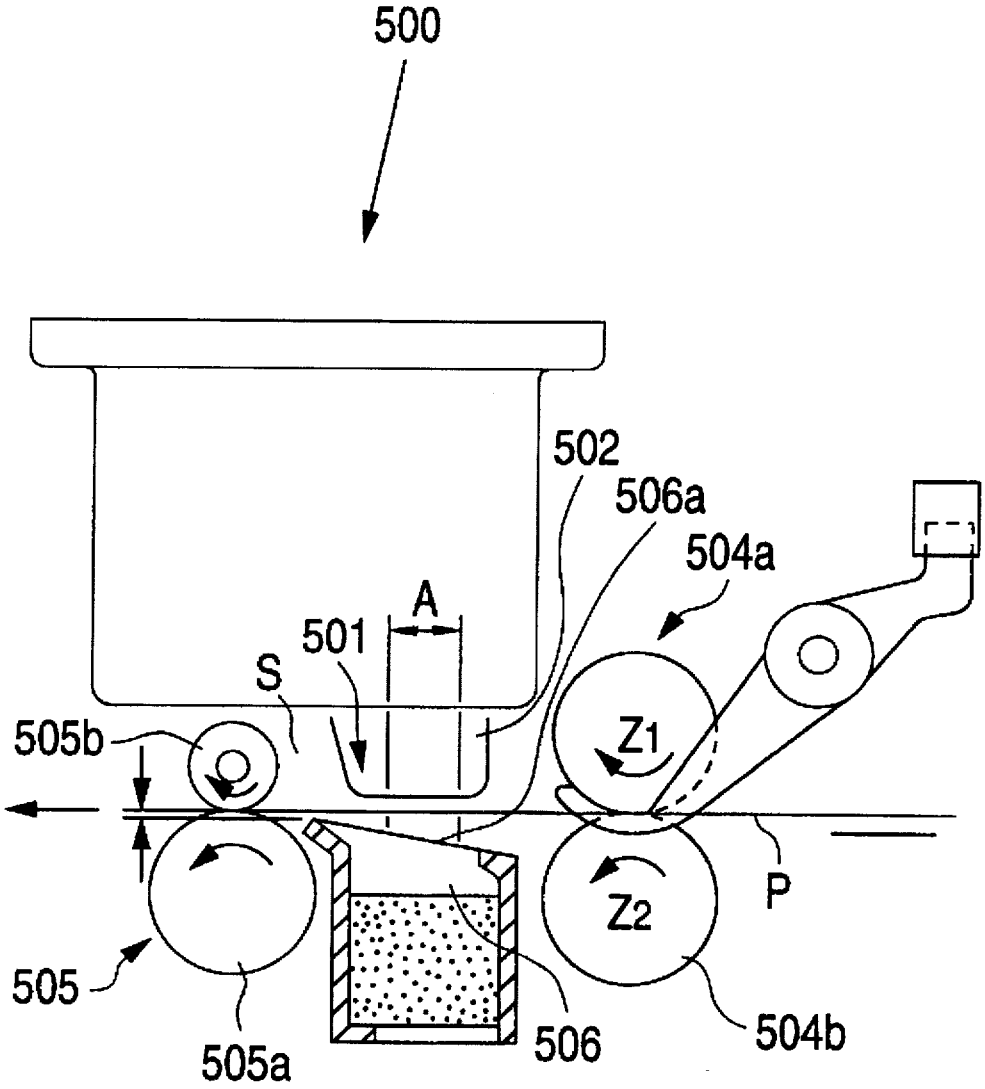
FIG. 36 PRIOR ART

The support faces of these support pieces are, as shown in FIG. 14, arranged so that they are situated inside the serrated roller 72' located at the rightmost position of what forms one pair of the paper discharge rollers. In a conventional printer shown in FIG. 25, a support face 612*a* is arranged so that it is situated at the same position in the width direction of discharged paper as that of serrated roller 606' in contact with the surface of copying paper P. A simplified elevational view of the conventional printer discharge arrangement is shown in FIG. 31. In this arrangement, discharged paper side edge Pe is allowed to rise and contact head 660', whereby the paper might become soiled.

To overcome this problem, as shown in FIG. 14, the side of paper P is held down by the serrated roller 72' because support face 91*d* is situated inside serrated roller 72' in the width direction of discharging paper. As such, the paper side edge Pe is prevented from touching head 60 and consequently is kept from being stained thereby.

The aforementioned problem of the right side edge being stained by repeated contact with head 60 is also common to the left edge of paper in a conventional printer. Therefore, according to this embodiment, first support member 81 of left support assembly 80 for supporting the left-side portion of discharging paper is similarly positioned. As shown in FIG. 2, line A4*e* represents the left-side edge of discharged paper of A4 size and dashed line A4 represents upper edge face 81*d* of first support member 81. When A4 paper is used, support face 81*d* is positioned slightly inside serrated roller 72A4 in the width direction of discharged paper to hold down the upper left-side portion of discharged paper and prevent the paper from contacting head 60. Similarly, when B5 size paper is used, support face 81*d* is positioned slightly inside serrated roller 72B5 in the width direction of discharged paper to hold down the upper left-side portion of discharged paper and prevent the paper from contacting head 60. In this manner, the left-side edge of the discharged paper is prevented from touching head 60 and is kept from being stained thereby.

Incidentally, as is shown at the top of FIG. 2, this embodiment is capable of accepting paper over a width M. Furthermore, A4 is the maximum size paper on which characters are printable over the whole width. Notwithstanding, B4 paper also may be conveyed into width M for printing purposes. As such, left support assembly 80 is positioned at the leftmost end of the printer face (the position where support assembly 80 is depicted in the solid line) beyond width M. The left-side edge is not soiled, however, because head 60 cannot reach that position.

Reference is made to FIG. 5. Holder 19*a* is mounted and rotatably supported within discharge portion 120 to support plate 53. Holder 19*a* includes guide blade 19*b* and serrated roller 19 rotatably mounted in holder 19*a*. As paper P is discharged by pairs of discharge rollers 71 and 72, the leading edge Pf abuts guide blade 19*b*. The force of paper P against guide blade 19*b* causes holder 19*a* to rotate in the direction indicated by arrow Y. Leading edge Pf of paper P is urged downwardly by guide blade 19*b* and is guided by serrated roller 19 through discharge portion 120.

An ink-jet printer of this embodiment has the following function and effect.

First, the size of paper used in the printer is set where the paper P is fed into the printer, at hopper 22 and paper feed tray 24. Thus, by setting the paper size, the user automatically ensures that the paper is properly supported when it is discharged. That is, when the user varies the paper size from A4 to B5, for example, and slides side plate 23*d* of edge guide 23 to abut against the edge of the paper, the interlocking mechanism operates such that left support assembly of discharge portion 120 slides into a position to provide proper paper discharge support.

Second, when the printer operation is started, automatic paper supply unit 20 feeds paper through paper channel PP. When paper P reaches paper feed rollers 30, it is fed out of paper feed rollers 30 at a feed angle defined by pinch rollers 40. Because pinch rollers 40 automatically align to contact properly paper feed rollers 30, paper P is prevented from moving obliquely.

Figure 4:
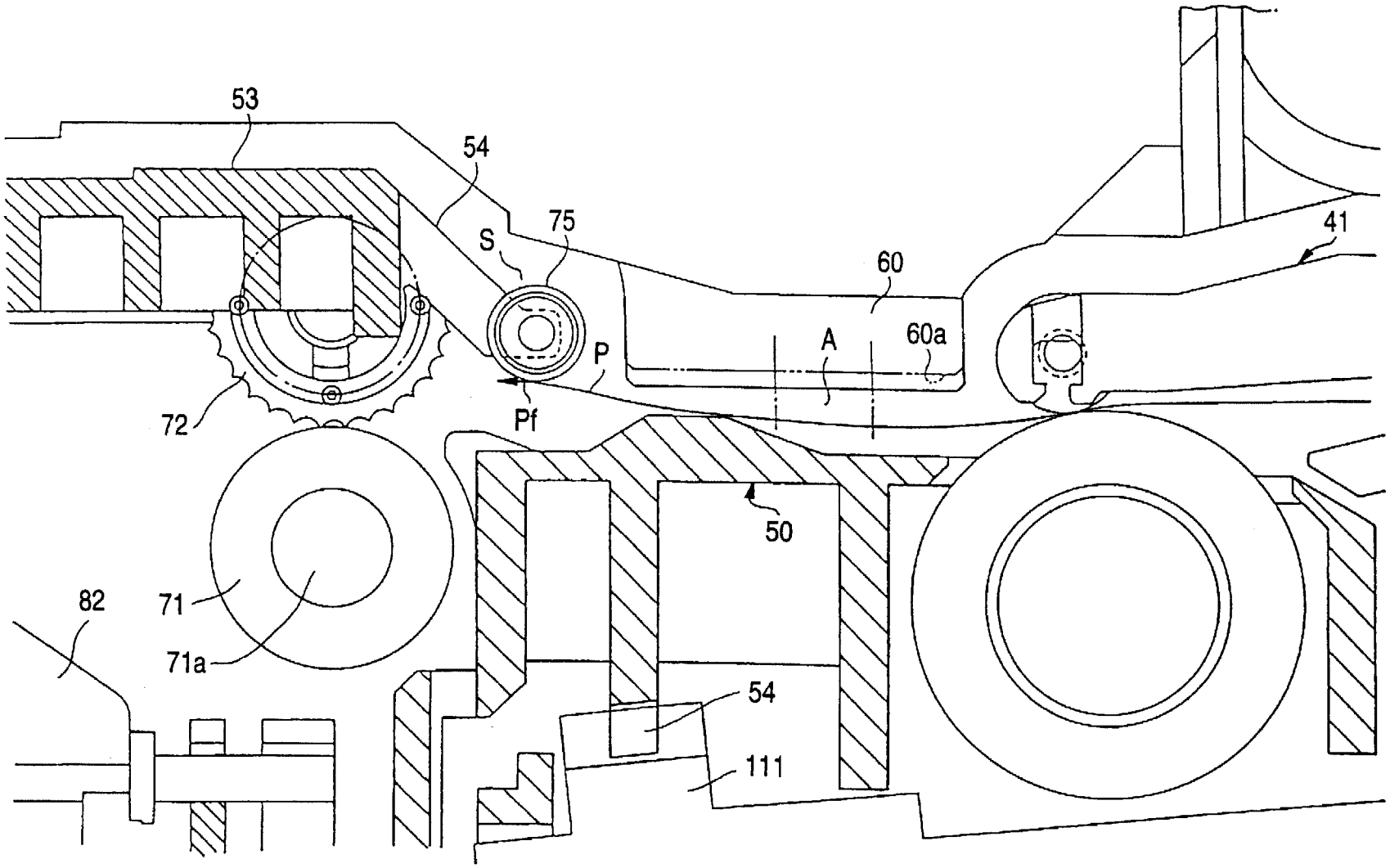
FIG. 4 is an enlarged sectional view of a portion of the ink jet printer constructed in accordance with the invention.

Third, as shown in FIG. 3, the leading edge of paper P fed by paper feed rollers 30 are guided and urged upwardly by slanting surface 51*b* of regulating member 50, while the gap between the surface of the paper and head 60 is regulated by the bottom surface Pb of paper P abutting the top surface 51*a* of rib 51. After the top front surface Pa of paper P is printed upon by ink being discharged from head 60, the leading edge Pf of paper P moves towards discharge rollers 71 and 72. Paper P may be badly warped at this stage of printing, and, therefore, as shown in FIG. 4, guide roller 75 is provided between head 60 and the pair of discharge rollers 71 and 72 to more precisely redirect paper P toward pairs of discharge rollers 71 and 72. That is, even if paper P is warped, leading edge Pf of the paper is prevented from entering space S between head 60 and the pair of discharge rollers 71 and 72. Therefore, paper P does not contact head 60 and paper jamming does not occur.

Furthermore, when thick paper such as postcards or envelopes are to be printed upon, the position of head 60 is positioned upwardly as depicted by the chain line in FIG. 4. In this situation, because the gap between the lower surface 60*a* (nozzle aperture surface, i.e. ink discharge surface) of head 60 and regulating member 50 becomes larger, there is a tendency for the leading edge Pf of the paper to enter more readily space S between head 60 and the pair of discharge rollers 71 and 72. However, the leading edge Pf of paper P is reliably prevented from entering space S between head 60 and the pairs of discharge rollers 71 and 72 by guide roller 75.

Moreover, because paper feed path PP is a curved paper feed path, the size of the printer can be made smaller than a printer having a straight paper feed path. That is, by making paper feed path PP curved, the tendency for the leading edge Pf of paper P to easily enter space S between head 60 and the pair of discharge rollers 71 and 72 is encouraged, but in this embodiment, paper P is reliably directed towards the pair of discharge rollers 71 and 72 by guide roller 75.

Additionally, because the rear surface Pb of conveyed paper P abuts ribs 51 of regulating member 50, the gap between head 60 and paper P is regulated and printing is carried out without the possibility that paper jamming will occur. Further, since ribs 51 are elongated when viewed in the paper conveying direction, they do not disturb the conveyance of the paper. Because the plurality of ribs 51 are formed in a direction perpendicular to the direction of paper conveyance, even if high density ink dots are formed on paper P and the paper wrinkles due to the ink moisture content, ribs 51 accommodate the swelling of the paper into the spaces 51*s* between adjacent ribs 51 (see FIG. 15C). Because of this construction, even if paper P wrinkles, the paper does not abut head 60 and ink smudging does not occur.

Figure 15A:
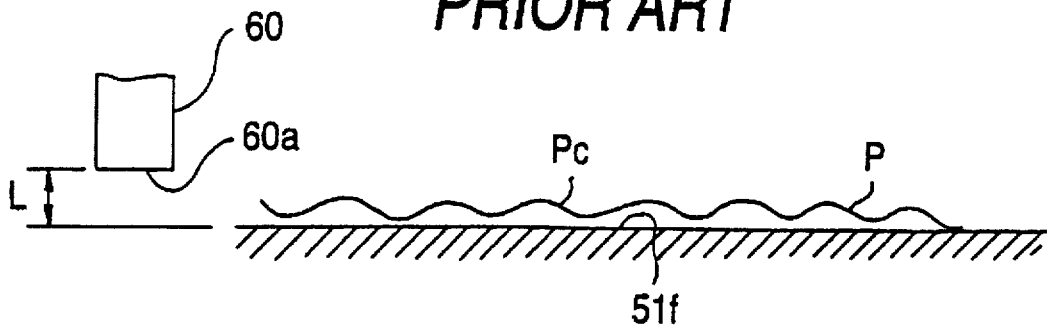
FIG. 15A PRIOR ART
FIGS. 15A and 15B are schematic views of warped paper passing beneath the printing section in accordance with the prior art.
Figure 15B:
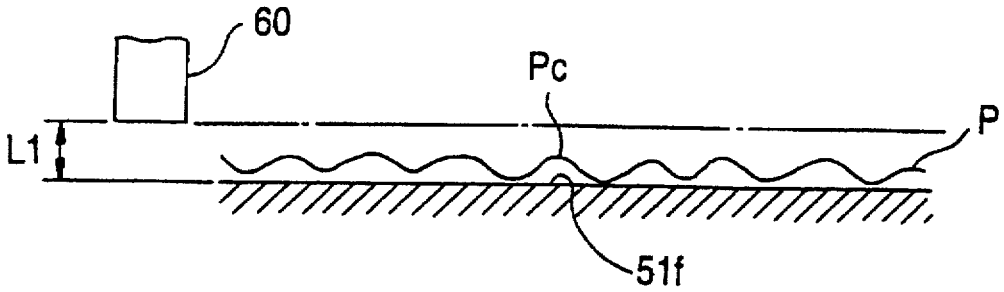
FIG. 15B PRIOR ART
Figure 15C:
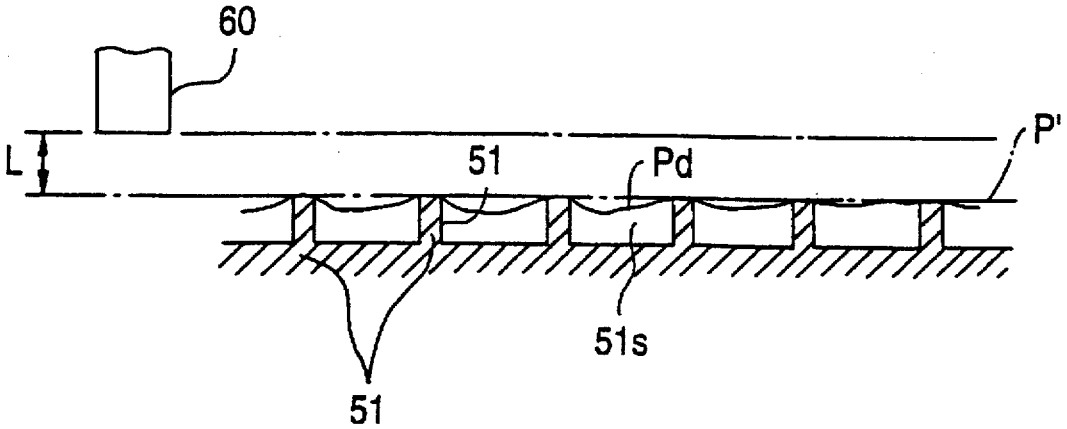
FIG. 15C is a schematic view of paper passing between the printing section and a regulating member constructed in accordance with the present invention.

More particularly, as depicted in FIGS. 15A–15C, the distance L is the ideal gap distance between head 60 and a sheet of paper P that has not wrinkled. Paper P moves across flat surface 51*f* of regulating member 50. Where the gap between paper P and head 60 is the ideal gap L, when paper P wrinkles due to the ink moisture content thereon, the protruding portions Pc of wrinkled paper P and the ink discharge surface 60*a* of head 60 will contact each other.

Figure 17A:
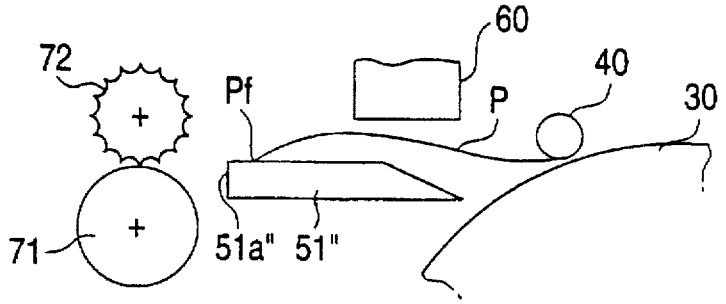
FIG. 17A PRIOR ART
FIG. 17A is a schematic view of a rib member constructed in accordance with the prior art.
Figure 17B:
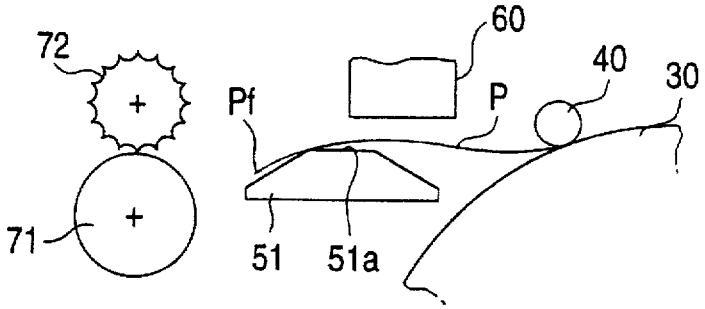
FIG. 17B is a schematic view illustrating a rib member constructed in accordance with the present invention.

One contemplated method to solve this problem, as shown in FIG. 17B is to provide a gap L1 between flat surface 51*f* and head 60 that is larger than the aforementioned gap L. As gap L1 is made larger, however, if the paper is not wrinkled and as such is in a flat condition, the distance between the paper guided by flat surface 51*f* and the head 60 (that is, roughly the distance L1) is too large and, therefore, the ideal printing gap cannot be obtained. If the distance the ink drops discharged from head 60 must travel to strike the surface of the paper is too large, the margin for error between the ideal striking point and the actual striking point on the paper increases.

To overcome this problem, extending ribs 51 extend from surface 51 as depicted in FIG. 15C. In the situation where the ink density is comparatively small, that is, where the paper does not wrinkle, paper P' is in a flat condition and is guided by the upper surface of ribs 51 and the distance between the paper P' and head 60 can be set at the aforementioned ideal distance L. In the case where ink dots are formed on the paper at high density and the paper wrinkles due to the ink moisture content therein, the paper may swell causing trough portions Pd. These trough portions Pd are accommodated into the spaces 51*s* between adjacent ribs 51. Therefore, even if paper P' wrinkles, the protruding portions Pc (FIG. 15B) will not abut head 60 thereby reducing the possibility of ink smudging.

Figure 16A:
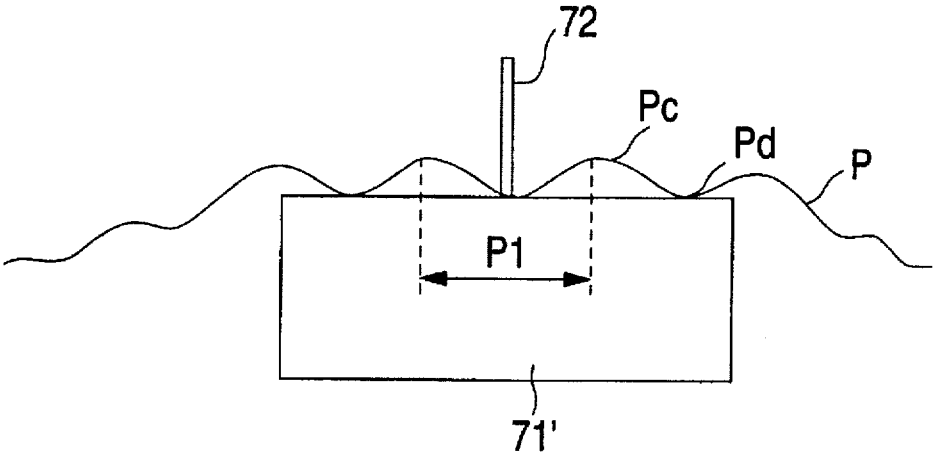
FIGS. 16A and 16B are schematic views showing operation of various paper discharge rollers.
Figure 16B:
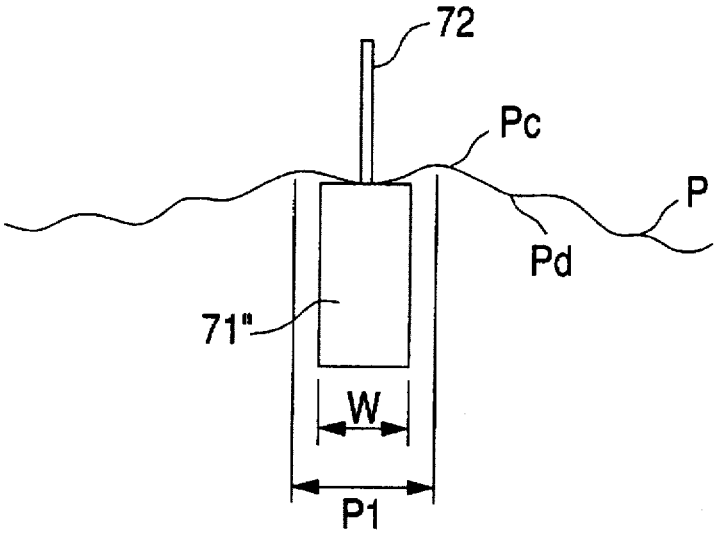

Reference is now made to FIGS. 16A and 16B. Among each roller 71 of the pairs of rollers 71 and 72, it is preferable that downwardly extending rubber roller 71 is not a long, round, rod-shaped roller (such as roller 71'), but rather a plurality of narrow rollers arranged along the width of the paper path. If rollers 71 are narrow in width, even if, for example, a high ink moisture content causes paper P to wrinkle and swell and create trough portions Pd, the paper will feed much more effectively if the trough portions Pd can hang over the edges of rollers 71. For example and as illustrated in FIG. 16B, it is desirable that the width of rubber rollers 71 be set as small as possible within a range that still permits accurate and reliable paper conveyance. An example of a preferably narrow roller is depicted in FIG. 16B as roller 71". The width W of the rubber roller 71" is narrower than the wave pitch P1 of the wrinkled paper. In a preferred embodiment, the width of roller 71" is approximately 5 mm. With this construction, the trough portions Pd of wrinkled paper P can hang over the edges of roller 71". On the other hand, it is undesirable to have the roller construction depicted in FIG. 16A, which illustrates a long roller 71'. In this situation, the trough portion Pd of the wrinkled paper P will rest on roller 71'. Therefore, even if serrated roller 72 attempts to urge paper P downward, protruding portion Pc will remain in a raised condition.

Another advantage of the present invention, is that when paper P contacts pairs of discharge rollers 71 and 72, paper P is placed in a taut condition between paper feed rollers 30 and the pairs of discharge rollers 71 and 72 because of the aforementioned rotational speed differential between rollers 71 and 72 and paper feed rollers 30. When high density ink dots are formed on paper P, even if the paper wrinkles due to the ink moisture content, the swelling of the paper is reduced due to the tension force within paper P and a more reliable printing operation is achieved. Yet further, as regulating member 50 urges paper P towards the ink jet head side and abuts the rear surface Pb of paper P, the swelling of paper P is positioned a sufficient distance away from head 60. Because of this, even if the paper has wrinkled, the paper does not contact head 60 and the likelihood of ink smearing is greatly reduced. Moreover, in the above-mentioned fashion, as the swelling of the paper is accommodated into the spaces 51*s* between adjacent ribs 51, the contacting of wrinkled paper and head 60 and subsequent ink smudging is more reliably prevented.

Reference is now made to FIGS. 17A, 17B in connection with the following disclosure to highlight the following beneficial operational effects obtained by the construction of ribs 51 in a substantially trapezoidal shape. First, in a serial printer that prints single lines upon sequentially receiving printing data for single lines from a host computer, for example, it is necessary to be able to feed paper in a reverse direction (that is, reverse feed), because the printing region of enlarged characters is larger than the printing region of standard characters. Therefore, as the paper is fed in a reverse direction, the enlarged characters are printed by a method of divided printing with multiple passes, that is, by the head scanning and paper feeding the length of the printing region A shown in FIG. 3. In this situation, it is necessary to feed paper in a reverse direction to complete the printing of the enlarged characters. If ribs 51 did not have a trapezoidal shape when viewed from the side, but rather, for example, had a rectangular shape when viewed from the side (see FIG. 17A, rib 51"), and there was an obstruction during the reverse feeding operation on the rear surface of a paper (for example, an envelope flap), the edge of paper P could become caught on the rib edge 51*a*" when reverse feeding occurred, a pitch defect would develop, and an inaccurate printing operation would occur. That is, the necessary line distance of reverse feeding and the amount of paper fed immediately afterwards in a forward direction would be disrupted.

To overcome this problem, ribs 51 are preferably of a substantially trapezoidal shape when viewed from the side. Therefore, even if during a reverse feeding operation there is an obstruction such as a flap portion of an envelope, for example, the trapezoidal shape of the rib reduces any catching and consequently, pitch defects do not develop and a reliable paper feed operation is assured.

Secondly, when printing is carried out near leading edge Pf of paper P, the leading edge Pf may become curved. However, if ribs 51" are not trapezoidally shaped (as in FIG. 17A, rib 51") the leading edge Pf of the paper may rest upon the upper surface of ribs 51" leading up to the pairs of discharge rollers 71 and 72. The paper P will be raised in the area of head 60 and the possibility of ink smearing against head 60 increases.

To overcome this problem, because the ribs 51 in the present embodiment have a substantially trapezoidal shape when viewed from the side (as shown in FIG. 17B) the leading edge Pf of paper P soon moves away from the uppermost surface 51*a*, and as a consequence, the appearance of the paper floating is reduced and the possibility of ink smudging against head 60 is greatly reduced.

Moreover, regulating member 50 includes a guide portion 51*e* (FIG. 4) secured thereto for guiding the leading edge of paper P towards pairs of discharge rollers 71 and 72. Guide portion 51*e* is preferably positioned upstream of discharge rollers 71 and 72 and downstream of ribs 51 (relative to a forward paper conveying direction). Accordingly, even if ribs 51 were not formed with a substantially trapezoidal shape, the leading edge of paper P can be more reliably guided towards pairs of discharge rollers 71 and 72. Thus, providing guide portion 51*e* upstream of pairs of discharge rollers 71 and 72 in the paper conveyance direction and preferably not providing guide portion 51*e* in any other location, the leading edge of paper P is reliably guided towards pairs of discharge rollers 71 and 72 and abutting and smudging of paper P against head 60 is more reliably prevented.

Moreover, when a plurality of colors of ink is discharged from head 60 and color printing is performed, ink dots are formed on top of previously formed ink dots and the wrinkling in the paper may become particularly severe. However, because of the advantageous construction disclosed above, the possibility of abutting and ink smudging of the wrinkled paper P against head 60 is greatly reduced.

Reference is once again made to FIGS. 5, 19 and 20. Holder 19*a* is mounted and rotatably supported within discharge portion 120. Holder 19*a* includes guide blade 19*b* and serrated roller 19 rotatably mounted in holder 19*a*. Additionally, first support member 81 and second support member 91 include respectively formed sloping faces 81*d* and 91*d* (see also FIG. 2). First support member 81 is located in range B2 and as such is in the upright position. Second support member 91 is in the upright position. As paper P of A4 size is discharged by pairs of discharge rollers 71 and 72, the leading edge Pf will abut guide blade 19*b*. The force of paper P against blade 19*b* will cause holder 19*a* to rotate in the direction indicated by arrow Y (FIG. 5). However, the leading edge Pf of paper P is urged downwardly by guide blade 19*b* and is guided by serrated roller 19 through discharge portion 120.

At the same time, both side portions of the paper leading edge Pf are supported from below by sloping faces 81*d* and 91*d* of respective support portions 81 and 91. Therefore, the leading edge Pf is gradually guided upwards. Consequently, as paper P is gradually discharged, the leading edge Pf is urged into a hollow concave shape as shown in FIGS. 19 and 20.

Figure 19:
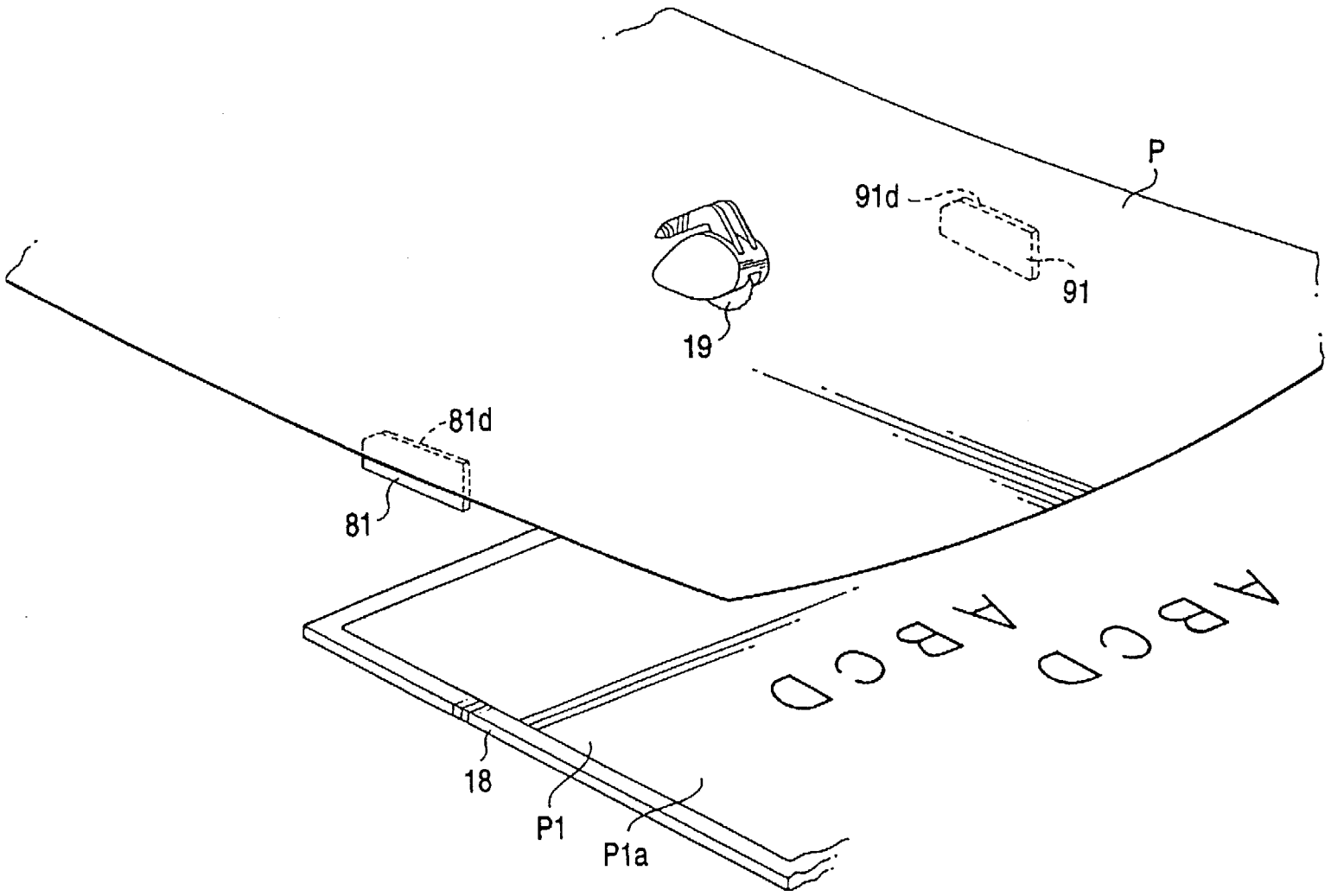
FIG. 19 is a perspective view of the paper discharge section in accordance with the present invention.

Art example of paper P being discharged while it engages sloping faces 81*d* and 91*d* and serrated roller 19 is depicted in FIG. 19. When viewed in the discharging direction, as paper P is forcibly urged into a hollow concave shape, the paper becomes stiff, and it is fed in the discharging direction in what appears to be a floating state. Because of this, the time until discharged paper P slidably contacts a printed surface P1*a* of previously printed and discharged stacked paper P1 is delayed. This delay permits sufficient time for the ink of already printed paper P1 to dry.

As paper P is further transported in a discharging paper direction, its trailing edge passes pairs of discharge rollers 71 and 72. The paper P therefore loses its transporting force and the rear portion of the paper is maintained in its concave state by means of discharge portion 120 and, specifically, by support positions 81 and 91 and holder 19*a*.

Figure 20:
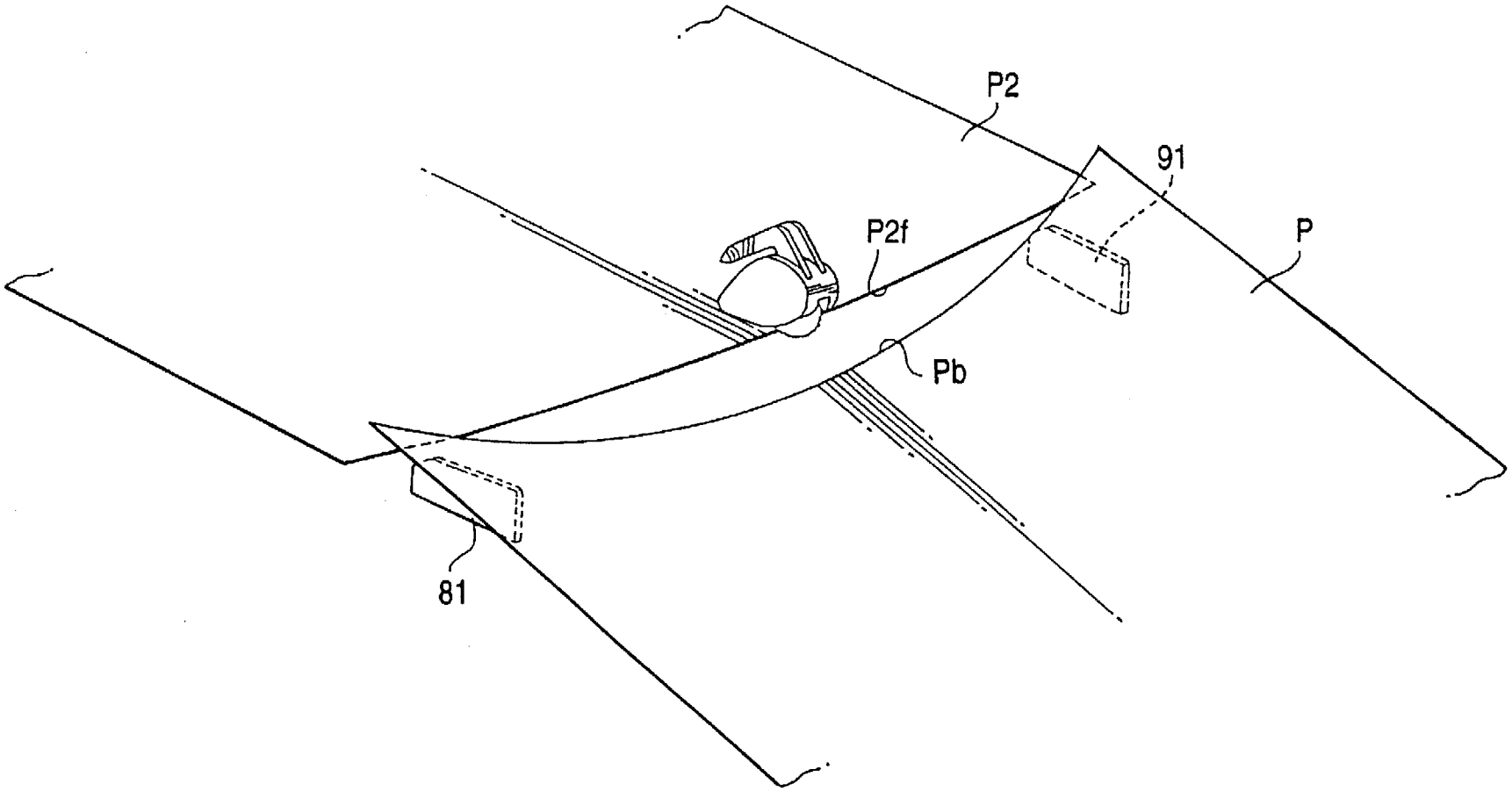
FIG. 20 is a perspective view of the paper discharge section during a paper discharge operation.

As shown in FIG. 20, as a subsequent sheet of paper P2 is printed its leading edge P2*f* passes pairs of discharge rollers 71 and 72. The hold on the previous paper P by discharge portion 120 is released when its trailing edge Pb is contacted by leading edge P2*f* of following paper P2. As the hold on previous paper P by discharge portion 120 is released, it is stacked on top of a previous already printed paper (P1 in FIG. 19). However, by the advantageous construction of discharge portion 120, the time until paper P contracts paper P1 is further delayed and sufficient time has elapsed for the ink on paper P1 to dry. The concavity of paper P allows paper P2 to easily and reliably contact the rear edge Pb of paper P. If paper P did not have any concavity, it would be very difficult to ensure that front edge P2*f* would contact rear edge Pb of paper P.

After leading edge P2*f* of paper P2 contacts trailing edge Pb of paper P and contact of paper P with support portions 81, 91 and serrated roller 19 is released, forward conveyance of paper P2 is momentarily stopped. This stopping operation can be performed by the counting of pulses of the motor (not shown) that drives pairs of discharge rollers 71 and 72. When the desired number of pulses has reached the predetermined number, the motor drive mechanism can be restarted and paper P2 can continue to be fed through discharge portion 120. By adopting a pushing-out method that includes momentarily stopping paper P2 from being further discharged as paper P is being stacked upon previous printed sheets of paper, and where leading edge P2*f* of paper P2 contacts trailing edge Pb of paper P when paper P is in a concave state, leading edge P2*f* of following paper P2 and trailing edge Pb of previous paper P can reliably engage each other and the paper stacking operation (dropping operation) of paper P on the previous already printed paper P1 (see FIG. 19) becomes very reliable. Absent an operation where paper P2 is momentarily stopped, the reliability of the stacking operation and the ability to ensure that the ink will have sufficient time to dry are diminished.

When relatively firm paper of B5 size or smaller, such as envelopes, is used, as shown in FIG. 19, the curved condition of relatively flexible paper is not attained by supporting it with the pair of upward-tilted support faces 81*d* and 91*d*. Consequently, following paper P2 does not contact preceding paper P to reliably stack paper in paper discharge tray 18.

Figure 21:
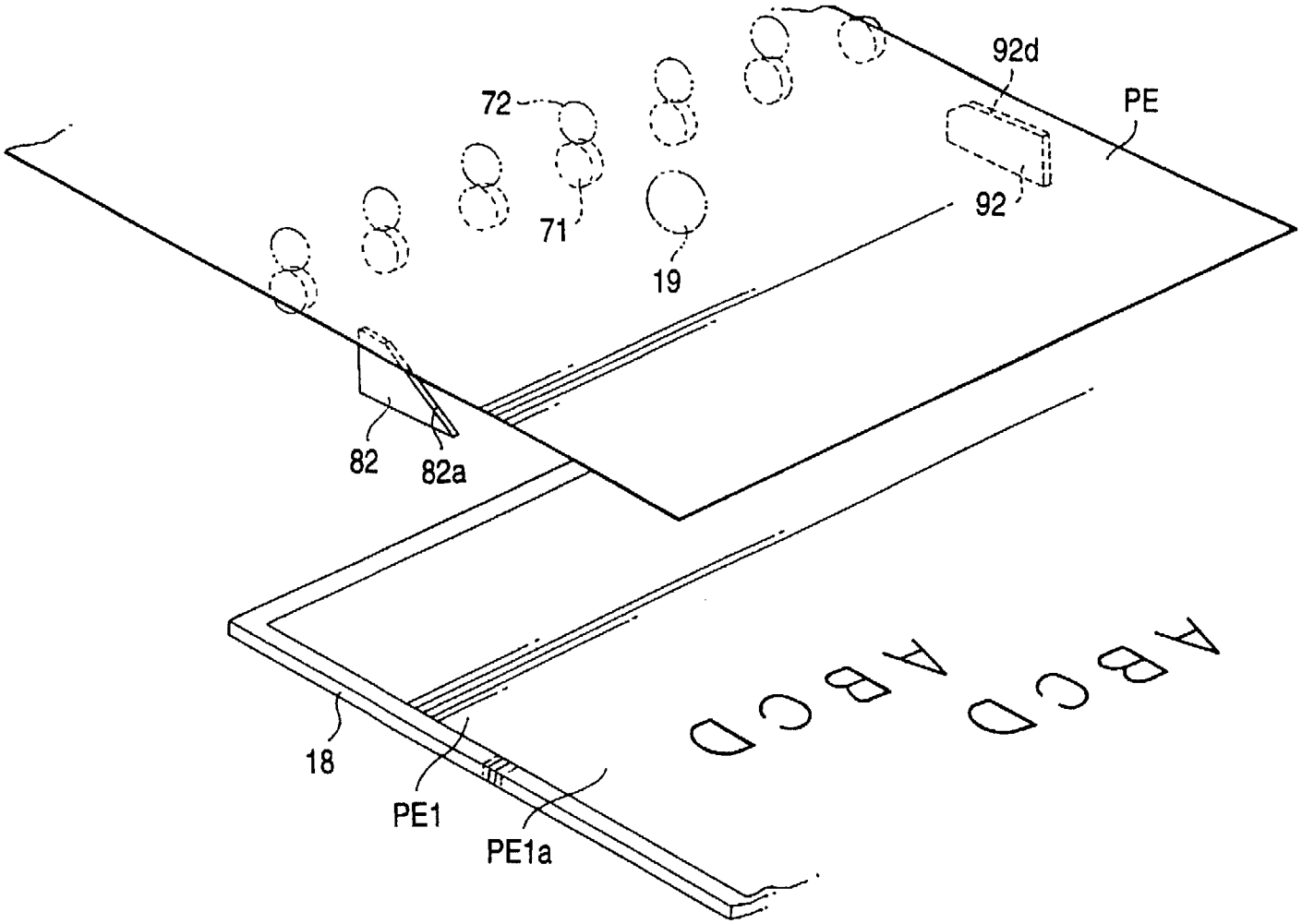
FIG. 21 is a perspective view of the paper discharge section during paper discharge operation.

To overcome this problem, as shown in FIG. 21, first support member 81 of left support assembly 80 is manually placed in the prone position, thereby exposing second support member 82, and second support member 92 of support assembly 90 is kept in the upright position. In this configuration, paper PE is discharged by pairs of paper discharge rollers 71 and 72 and is supported in a substantially horizontal condition (in the floating condition) by pairs of discharge rollers 71 and 72 and second support member 92, and due to the stiffness of paper PE until the rear edge of the paper passes through the pairs of paper discharge rollers 71 and 72. Thus, the discharge of paper PE and its subsequent stacking on previously discharged paper PE1 is delayed to allow time for the ink to dry on paper printing face PE1*a*. During the discharge of paper PE but prior to it being released, second support member 82 is located under paper PE and either does not contact paper PE or does so lightly. Although support face 92*d* of second support member 92 slopes upward relative to the feed path, it is lower than support face 91*d* of first support member 91 and does not create a high resistance to discharging copying paper. If firm paper PE was supported and guided by first support member 81 and first support member 91, they would create a high resistance to firm paper PE because the paper would not readily curve as the support member faces 81*d* and 91*d* are situated at a relatively high level and are sloped up in the direction of discharging paper. Thus, to prevent this situation, second support member 91 is used to support the paper, although in this configuration the precision of the paper feed may be diminished.

Figure 22:
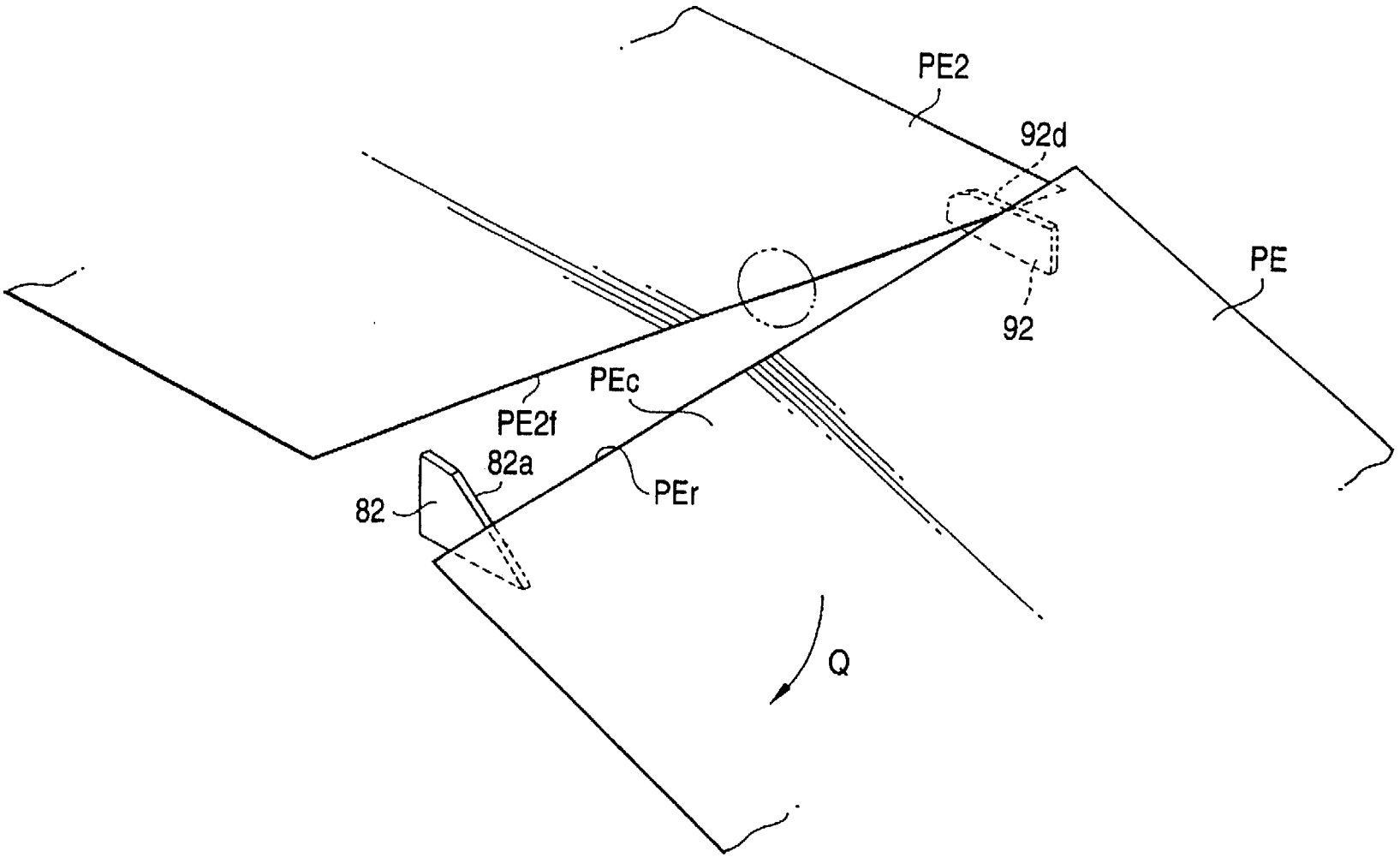
FIG. 22 is a perspective view of the paper discharge section during paper discharge operation.

When paper PE is conveyed further and the rear edge PEr of paper PE passes between the pairs of discharge rollers 71 and 72, the conveyance force is lost, and, as shown in FIG. 22, the rear edge portion PEc of the paper is held in a right-hand, up-sloped position by second support member 92 and the down-sloped support face 82*a* of second support member 82. Further, as shown in FIG. 22, when paper PE2 enters discharge portion 120 and its leading edge PE2*f* passes between the pairs of discharge rollers 71 and 72, it abuts against the rear edge PEr of the preceding paper PE, and paper PE is pushed by paper PE2 prior to being stacked on preceding printed paper PE1 FIG. 21). Because following paper PE2 contacts paper PE in the vicinity of second support member 92, paper PE2 attempts to turn paper PE in the direction of arrow Q around support member 82*a*. Paper PE is prevented from turning by the down-sloped support face 82*a*. Instead, paper PE slides down support face 82*a* and is discharged in a relatively straight position.

When ordinary paper of A4 or B5 size are printed, edge guide 23 is slid to the right and, as stated above, lower pin 81*g* of first support member 81 abuts against the third or the second plate 59*b*, whereby first support member 81 automatically assumes an upright position. When, for example, printing is desired on small-size envelopes or postcards, and as depicted in FIG. 2, edge guide 23 is positioned close to side plate 16*c'* of sub frame 16, which forms the second and opposing edge guide, edge guide 23 may be slid from its left-most position to the position shown by the chain line, left support assembly 80 passes switch 59, and first support member 81 automatically assumes a prone position, exposing second support member 82.

Figure 23:
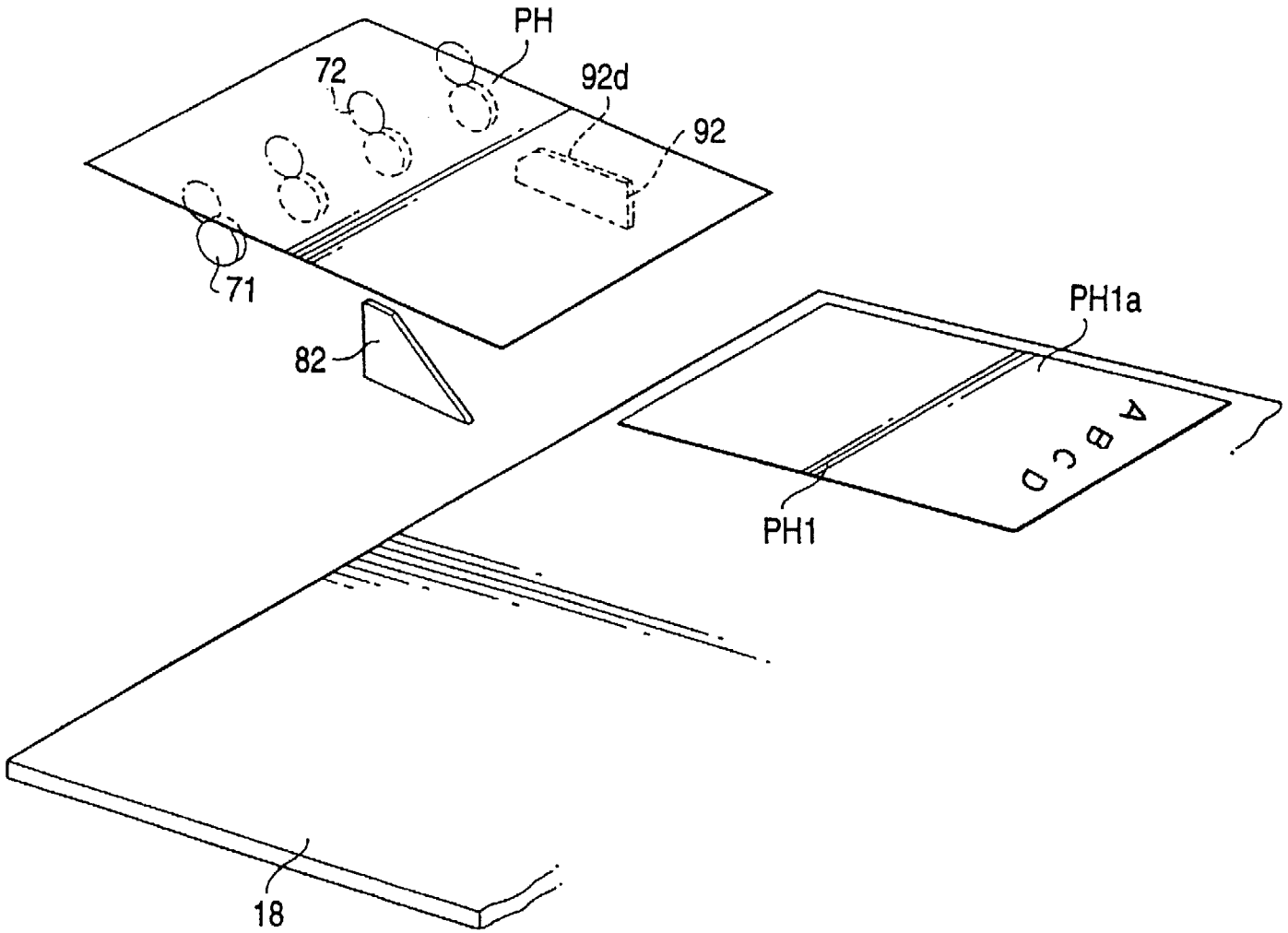
FIG. 23 is a perspective view of the paper discharge section during paper discharge operation.

The second support member 92 of right support means 90 is manually set in the upright position by the above-described method. Referring to FIG. 23, when pairs of paper discharge rollers 71 and 72 discharge paper PH, the paper is supported substantially in a horizontal position (in floating condition) by pairs of discharge rollers 71 and 72 and second support member 92 before being discharged as the copying paper PH is firm until its rear end passes between the pairs of paper discharge rollers 71 and 72. As such, the discharge of paper PH is delayed long enough so that the ink printed on paper PH1 dries before paper PH rubs against already discharged and stacked paper PH1 and printed surface PH1*a*.

Second support member 82 is located under paper PH at this time and either does not contact or is in light contact with paper PH. Although support face 92*d* of second support member 92 slopes upward, it is lower than support face 91*d* of first supper member 91 and does not create a high resistance to discharged paper.

Figure 24:
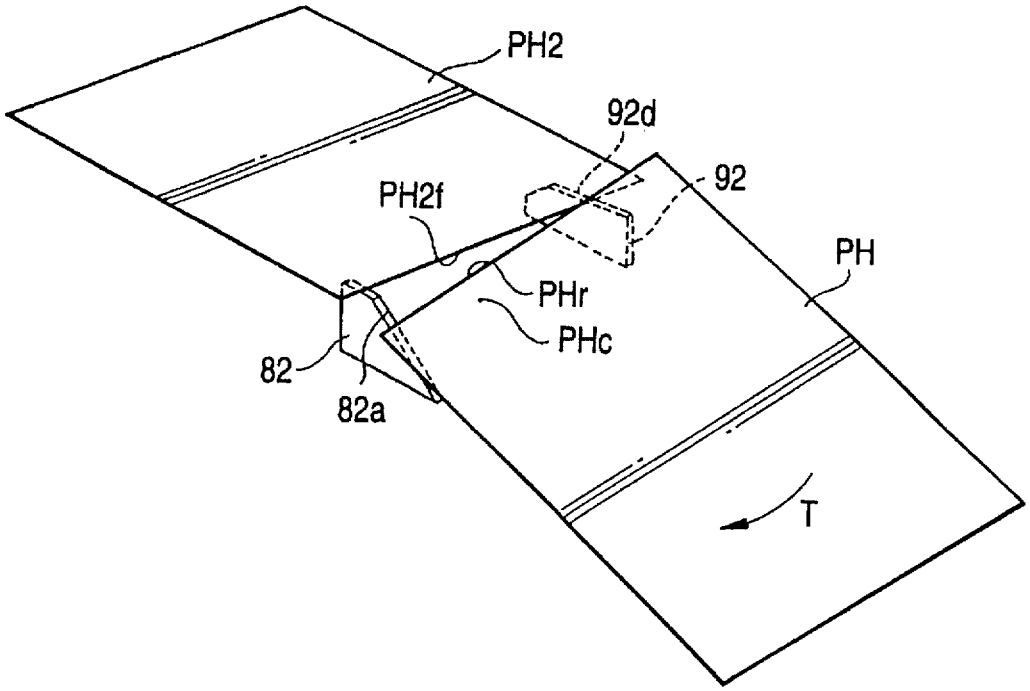
FIG. 24 is a perspective view of the paper discharge section during paper discharge operation.

When paper PH is conveyed further and the rear edge of paper PH passes between the pairs of discharge rollers 71 and 72, the conveyance force is lost and, as shown in FIG. 24, the rear edge PHc of paper PHr is held in a right-hand, up-sloped position by second support member 92 and by the down-sloped support face 82*a* of second support member 82. Further, when leading edge PH2*f* passes between pairs of paper discharge rollers 71 and 72 and contacts the rear edge Phr of the preceding paper PH, the preceding paper PH is pushed by the following paper PH2 before being stacked on preceding printed paper PH1 (FIG. 23). Because following paper PH2 pushes paper PH in the vicinity of second support member 92, paper PH2 attempts to turn paper PH in the direction of arrow T around first support member 82. Paper PH is prevented from turning, however, by the down-sloped support face 82*a*, it slides down support face 82*a*, and is discharged in a relatively straight position.

When characters are printed on ordinary paper of A4 or B5 size, edge guide 23 is slid to the left and, as stated above, upper pin 81*f* of first support member 81 abuts against second plate 59*b*, whereby first support member 81 automatically assumes an upright position.

The above is an explanation of the embodiments of this invention, but the present invention is not limited to the embodiments described above. That is, variations are also possible while remaining within the scope of the invention. For example, in the first embodiment, only one guide roller 75 is provided in a position corresponding to the flap portion of an envelope (thick portion), but there are cases in which the entire paper bends, bulges or is warped. Accordingly, a plurality of guide rollers may also be provided to take this situation into account. Furthermore, guide roller 75 is preferably formed of a water repellent plastic. However, a serrated roller may also be used. A serrated roller is advantageous because the serrated nature of the roller is effective in preventing the ink from smearing or the paper from staining.

Thus, according to the present invention, by setting the paper edge guide to the location appropriate to the type of paper used in printing, proper support is attained upon discharge from the printing area. Further, firm paper is discharged in a straight manner to allow neat stacking.

It will thus be seen that the objects set forth above, among those made apparent from the preceding description, are efficiently attained and, since certain changes may be made in the above construction without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A paper discharge section for a printer having a printer body, said discharge section comprising:

a first support assembly mounted on said printer body and a second support assembly mounted on said printer body and spaced apart from said first support assembly, said first support assembly supporting a respective first bottom side portion of a sheet of paper discharged from said printer body and said second support assembly supporting a respective second bottom side portion of a sheet of paper, at least said first support assembly being a slidable support assembly slidable in a first direction along a slide path toward said second support assembly and a second direction away from said second support assembly;

said first support assembly including a first support member rotatable between a first position for supporting a first bottom side portion of a sheet of paper with a first support surface and at least a second position in which said first support member does not support said first bottom side portion of a sheet of paper;

a switch mounted on said printer body, said switch selectively causing said first support member to rotate between a first position for supporting a first bottom side portion of a sheet of paper to a second position in which said first support member does not support a first bottom side portion of a sheet of paper and from said second position to said first position.

2. The paper discharge section as claimed in claim 1, said first support assembly further comprising a second support member, said first support member supporting a respective first bottom side portion of a sheet of paper discharged from said printer body when said first support member is in the first position, and said second support member supporting the bottom side portion of a sheet of paper discharged from said printer body when said first support member is in the second position.

3. The paper discharge section as claimed in claim 2, said first support member having a first support face for supporting said sheet of paper and said second support member having a second support face for supporting a sheet of paper.

4. The paper discharge section as claimed in claim 2, wherein said first support member includes a first support face sloping upward in the direction of discharge of a sheet of paper discharged from said printer body.

5. The paper discharge section as claimed in claim 2, wherein said second support member includes a support face sloping downward in the direction of discharge of a sheet of paper discharged from said printer body.

6. The paper discharge section as claimed in claim 3, wherein said second support member includes a support surface sloping downward in the direction of discharge of a sheet of paper discharged from said printer body.

7. The paper discharge section as claimed in claim 5, wherein said second support assembly includes a third support member having a third support face, and a fourth support member having a fourth support face, said third and fourth members being rotatably mounted within said print body to rotate between a first position for supporting a second bottom side portion of a sheet of paper and at least a second position in which said fourth support member supports said second bottom side portion of a sheet of paper.

8. The paper discharge section as claimed in claim 7, wherein said third and said fourth support members are of different lengths.

9. The paper discharge section as claimed in claim 1, wherein said switch is mounted within said body along said slide path, said switch contacting said first support assembly to cause said first support member to rotate between said first position and second position as said sliding support assembly slides in a first direction and to rotate between said second position and said first position when said sliding support assembly slides in a second direction.

10. The paper discharge section as claimed in claim 9, wherein said slide path defines a first range and a second range, said switch causing said first support member to rotate between said first position and said second position when said sliding support assembly moves from said first range to said second range.

11. The paper discharge section as claimed in claim 9, wherein said slide path defines a first range and a second range, said switch causing said first support member to rotate between said second position and said first position when said sliding support assembly moves from said second range to said first range.

12. The paper discharge section as claimed in claim 10, wherein said first support member supports said first bottom side portion of paper when in said first range.

13. The paper discharge section as claimed in claim 10, wherein said first support member does not support said first bottom side portion of paper when in said second range.

14. The paper discharge section as claimed in claim 9, wherein said slide path defines a first range and a second range, said switch causing said first support member to rotate between said second position and said first position when said sliding support assembly moves from said second range to said first range, said second support member not supporting said first end of paper when in said first range, said switch causing said first support member to rotate between said first position and second position when said sliding support assembly moves from said first range to said second range, said second support member supporting said first end of paper when in said second range.

15. The paper discharge section as claimed in claim 2, wherein said first support member includes a shaft, an arm integrally formed at one end of said shaft, at least one pin integrally projected from said arm; and wherein said switch includes at least one camming surface operatively engaging said pin causing said first support member to rotate between said first position for supporting a first bottom side portion of a sheet of paper to said second position in which said first support member does not support said first bottom side portion of a sheet of paper.

16. The paper discharge section as claimed in claim 15, further comprising a rail integrally formed with said camming surface, said rail preventing said first support member from rotating to said first position.

17. The paper discharge section as claimed in claim 16, wherein said switch further comprises at least a second camming surface integrally formed with said printer body and operatively engaging said pin causing said first support member to rotate between said second position in which said first support member does not support said first bottom side portion of a sheet of paper to said first position for supporting a first bottom side portion of a sheet of paper.

18. The paper discharge section as claimed in claim 17, wherein said at least second camming surface is vertically spaced from said first camming surface.

19. The discharge section as claimed in claim 1, wherein said first support assembly includes at least one retaining portion operatively coupled to said first support member and releasably securing said first support member in said second position where said first support member does not support a first bottom side portion of a sheet of paper.

20. A printer comprising:

a printer body including a print section therein;

a paper supply apparatus operatively mounted to said printer body and adapted to receive at least one sheet of paper on a surface thereof, said paper supply apparatus having a first edge guide for guiding a first side edge of a sheet of paper and a second edge guide spaced from said first edge guide for guiding a second side edge of a sheet of paper, at least one of said first and second edge guides being slidable in at least one of a first direction towards the other edge guide and a second direction away from the other edge guide to accommodate a width of a sheet of paper received in said paper supply apparatus;

a paper discharge section, said discharge section comprising a first support assembly mounted on said printer body and a second support assembly mounted on said printer body and spaced apart from said first support assembly, said first support assembly supporting a respective first bottom side portion of a sheet of paper discharged from said printer body and said second support assembly supporting a respective second bottom side portion of a sheet of paper, at least said first support assembly being a slidable support assembly slidable in a first direction towards said second support assembly and a second direction away from said second support assembly;

a linkage mechanism for linking said slidable edge guide to at least said first support assembly so as to cause at least said slidable edge guide and at least said first support portion to slide in unison;

said first support assembly including a first support member rotatable between a first position for supporting a first bottom side portion of a sheet of paper with a first support surface and at least a second position in which said first support member does not support said first bottom side portion of a sheet of paper;

a switch mounted on said printer body, said switch selectively causing said first support member to rotate between a first position for supporting said first bottom side portion of a sheet of paper to a second position in which said first support member does not support a first bottom side portion of a sheet of paper and from said second position to said first position.

21. The printer as claimed in claim 20, said first support assembly further comprising a second support member, said first support member supporting a respective first bottom side portion of a sheet of paper discharged from said printer body when said first support member is in the first position, and said second support member supporting the bottom side portion of a sheet of paper discharged from said printer body when said first support member is in the second position.

22. The printer as claimed in claim 21, said first support member having a first support face for supporting said sheet of paper and said second support member having a second support face for supporting a sheet of paper.

23. The printer as claimed in claim 21, wherein said first support member includes a first support face sloping upward in the direction of discharge of a sheet of paper discharged from said printer body.

24. The printer as claimed in claim 21, wherein said second support member includes a support face sloping downward in the direction of discharge of a sheet of paper discharged from said printer body.

25. The printer as claimed in claim 22, wherein said second support member includes a support surface sloping downward in the direction of discharge of a sheet of paper discharged from said printer body.

26. The printer as claimed in claim 24, wherein said second support assembly includes a third support member having a third support face, and a fourth support member having a fourth support face, said third and fourth members being rotatably mounted within said print body to rotate between a first position for supporting a second bottom side portion of a sheet of paper and at least a second position in which said fourth support member supports said second bottom side portion of a sheet of paper.

27. The printer as claimed in claim 26, wherein said third and said fourth support members are of different lengths.

28. The printer as claimed in claim 20, wherein said switch is mounted within said body along said slide path, said switch contacting said first support assembly to cause said first support member to rotate between said first position and second and second position as said sliding support assembly slides in a first direction and to rotate between said second position and said first position when said sliding support assembly slides in a second direction.

29. The printer as claimed in claim 28, wherein said slide path defines a first range and a second range, said switch causing said first support member to rotate between said first position and said second position when said sliding support assembly moves from said first range to said second range.

30. The printer as claimed in claim 28, wherein said slide path defines a first range and a second range, said switch causing said first support member to rotate between said second position and said first position when said sliding support assembly moves from said second range to said first range.

31. The printer as claimed in claim 29, wherein said first support member supports said first bottom side portion of paper when in said first range.

32. The printer as claimed in claim 29, wherein said first support member does not support said first bottom side portion of paper when in said second range.

33. The printer as claimed in claim 28, wherein said slide path defines a first range and a second range, said switch causing said first support member to rotate between said second position and said first position when said sliding support assembly moves from said second range to said first range, said second support member not supporting said first end of paper when in said first range, said switch causing said first support member to rotate between said first position and second position when said sliding support assembly moves from said first range to said second range, said second support member supporting said first end of paper when in said second range.

34. The printer as claimed in claim 21, wherein said first support member includes a shaft, an arm integrally formed at one end of said shaft, at least one pin integrally projected from said arm; and wherein said switch includes at least one camming surface operatively engaging said pin causing said first support member to rotate between said first position for supporting a first bottom side portion of a sheet of paper to said second position in which said first support member does not support said first bottom side portion of a sheet of paper.

35. The printer as claimed in claim 34, further comprising a rail integrally formed with said camming surface, said rail preventing said first support member from rotating to said first position.

36. The printer as claimed in claim 35, wherein said switch further comprises at least a second camming surface integrally formed with said printer body and operatively engaging said pin causing said first support member to rotate between said second position in which said first support member does not support said first bottom side portion of a sheet of paper to said first position for supporting a first bottom side portion of a sheet of paper.

37. The printer as claimed in claim 36, wherein said at least second camming surface is vertically spaced from said first camming surface.

38. The printer as claimed in claim 20, wherein said first support assembly includes at least one retaining portion operatively coupled to said first support member and releasably securing said first support member in said second position where said first support member does not support a first bottom side portion of a sheet of paper.

* * * * *